US010920529B2

(12) United States Patent
Mailand et al.

(10) Patent No.: US 10,920,529 B2
(45) Date of Patent: Feb. 16, 2021

(54) SURFACE CONTROLLED WIRELINE RETRIEVABLE SAFETY VALVE

(71) Applicant: Tejas Research & Engineering, LLC, The Woodlands, TX (US)

(72) Inventors: Jason C. Mailand, The Woodlands, TX (US); Case Nienhuis, Conroe, TX (US)

(73) Assignee: TEJAS RESEARCH & ENGINEERING, LLC, The Woodlands, TX (US)

( * ) Notice: Subject to any disclaimer, the term of this patent is extended or adjusted under 35 U.S.C. 154(b) by 0 days.

(21) Appl. No.: 16/378,740

(22) Filed: Apr. 9, 2019

(65) Prior Publication Data

US 2020/0190944 A1 Jun. 18, 2020

Related U.S. Application Data

(60) Provisional application No. 62/779,121, filed on Dec. 13, 2018.

(51) Int. Cl.
*E21B 34/10* (2006.01)
*E21B 34/14* (2006.01)
(Continued)

(52) U.S. Cl.
CPC ..... *E21B 34/106* (2013.01); *E21B 34/14* (2013.01); *E21B 34/16* (2013.01); *E21B 41/0021* (2013.01)

(58) Field of Classification Search
CPC ..... E21B 34/10; E21B 34/101; E21B 34/105; E21B 34/106; E21B 34/14; E21B 34/16; E21B 41/0021
See application file for complete search history.

(56) References Cited

U.S. PATENT DOCUMENTS 3,032,111 A * 5/1962 Corley, Jr. ..... E21B 34/066 166/66.7
3,070,119 A 12/1962 Max
(Continued)

FOREIGN PATENT DOCUMENTS

WO 2015094168 A1 6/2015
WO 2020036920 A1 2/2020

OTHER PUBLICATIONS

PCT International Search Report for PCT International Application PCT/US2019/065135, filed Dec. 9, 2019, by the International Search Authority (USPTO) dated Feb. 25, 2020.
(Continued)

*Primary Examiner* — Matthew R Buck
(74) *Attorney, Agent, or Firm* — Angelo IP; Basil M. Angelo

(57) ABSTRACT

A surface-controlled wireline-retrievable safety valve includes a seat housing having a plurality of flow ports that is configured to house a hard seat. A closure device has a plurality of equalization ports, is disposed within the seat housing, and is configured to controllably move off the hard seat and expose the plurality of flow ports to a central lumen of the safety valve under hydraulic actuation. A power piston having a shoulder portion includes a top end that is attached to the closure device and the shoulder portion is disposed within a hydraulic chamber housing forming a differential area. A hydraulic actuation port may be configured to receive hydraulic actuation fluid from a surface pump. A hydraulic passage may be configured to convey the hydraulic actuation fluid from the hydraulic actuation port to the differential area via a hydraulic access port.

19 Claims, 16 Drawing Sheets

(51) Int. Cl.
*E21B 34/16* (2006.01)
*E21B 41/00* (2006.01)

(56) References Cited

U.S. PATENT DOCUMENTS

| | | | | |
|---|---|---|---|---|
| 3,111,989 | A | 11/1963 | Tamplen | |
| 3,126,908 | A | 3/1964 | Dickens | |
| 3,310,114 | A | 3/1967 | Dollison | |
| 3,452,777 | A * | 7/1969 | Dollison | E21B 34/08 137/464 |
| 3,459,260 | A | 8/1969 | Dollison | |
| 3,696,868 | A | 10/1972 | Taylor, Jr. | |
| 3,763,932 | A | 10/1973 | Dinning | |
| 3,782,461 | A | 1/1974 | Watkins | |
| 3,786,863 | A | 1/1974 | Tausch | |
| 3,799,258 | A * | 3/1974 | Tausch | E21B 34/106 166/72 |
| 3,814,181 | A | 6/1974 | Young | |
| 3,845,818 | A | 11/1974 | Deaton | |
| 3,860,066 | A | 1/1975 | Pearce et al. | |
| 3,865,141 | A | 2/1975 | Young | |
| 3,865,151 | A | 2/1975 | Poole | |
| 3,971,438 | A | 7/1976 | Crowe | |
| 4,014,386 | A | 3/1977 | Johnson et al. | |
| 4,063,594 | A * | 12/1977 | Canterbury | E21B 34/06 166/325 |
| 4,129,184 | A * | 12/1978 | Parker | E21B 34/16 166/385 |
| 4,252,197 | A | 2/1981 | Pringle | |
| 4,339,001 | A | 7/1982 | Paschal, Jr. | |
| 4,354,554 | A | 10/1982 | Calhoun et al. | |
| 4,356,867 | A | 11/1982 | Carmody | |
| 4,434,847 | A | 3/1984 | Vazquez et al. | |
| 4,440,221 | A * | 4/1984 | Taylor | E21B 34/08 166/106 |
| 4,444,266 | A | 4/1984 | Pringle | |
| 4,460,046 | A | 7/1984 | Pringle | |
| 4,467,867 | A | 8/1984 | Baker | |
| 4,469,179 | A | 9/1984 | Crow et al. | |
| 4,538,838 | A | 9/1985 | Pringle | |
| 4,605,070 | A | 8/1986 | Morris | |
| 4,619,320 | A | 10/1986 | Adnyana et al. | |
| 4,660,646 | A | 4/1987 | Blizzard | |
| 4,664,195 | A | 5/1987 | Deaton | |
| 4,944,351 | A | 7/1990 | Eriksen et al. | |
| 4,945,993 | A | 8/1990 | Dickson et al. | |
| 4,976,317 | A | 12/1990 | Leismer | |
| 4,981,177 | A | 1/1991 | Carmody et al. | |
| 4,986,357 | A | 1/1991 | Pringle | |
| 5,070,944 | A | 12/1991 | Hopper | |
| 5,127,476 | A | 7/1992 | Dickson et al. | |
| 5,201,817 | A | 4/1993 | Hailey | |
| 5,226,483 | A | 7/1993 | Williamson, Jr. | |
| 5,249,630 | A | 10/1993 | Meaders et al. | |
| 5,305,828 | A * | 4/1994 | White | E21B 33/1294 166/120 |
| 5,310,004 | A | 5/1994 | Leismer | |
| 5,411,096 | A | 5/1995 | Akkerman | |
| 5,496,044 | A | 3/1996 | Beall et al. | |
| 5,564,675 | A | 10/1996 | Hill, Jr. et al. | |
| 5,598,864 | A | 2/1997 | Johnston et al. | |
| 5,799,949 | A | 9/1998 | Beall et al. | |
| 5,810,087 | A | 9/1998 | Patel | |
| 5,906,220 | A | 5/1999 | Thompson | |
| 6,003,605 | A | 12/1999 | Dickson et al. | |
| 6,202,747 | B1 | 3/2001 | Lacy et al. | |
| 6,237,693 | B1 | 5/2001 | Deaton | |
| 6,253,843 | B1 | 7/2001 | Rawson et al. | |
| 6,260,850 | B1 | 7/2001 | Beall et al. | |
| 6,269,874 | B1 | 8/2001 | Rawson et al. | |
| 6,283,477 | B1 | 9/2001 | Beall et al. | |
| 6,352,118 | B1 | 3/2002 | Dickson et al. | |
| 6,433,991 | B1 | 8/2002 | Deaton et al. | |
| 6,523,613 | B2 | 2/2003 | Rayssiguier et al. | |
| 6,523,614 | B2 | 2/2003 | Dennistoun et al. | |
| 6,619,388 | B2 | 9/2003 | Dietz et al. | |
| 6,659,185 | B2 | 12/2003 | Dennistoun et al. | |
| 6,742,595 | B2 | 6/2004 | Dennistoun et al. | |
| 6,880,641 | B2 | 4/2005 | Dennistoun et al. | |
| 6,902,006 | B2 | 6/2005 | Myerley et al. | |
| 7,032,672 | B2 | 4/2006 | Dennistoun et al. | |
| 7,137,452 | B2 | 11/2006 | McVicker | |
| 7,188,674 | B2 | 3/2007 | McGavern, III et al. | |
| 7,195,072 | B2 | 3/2007 | MacKay et al. | |
| 7,392,849 | B2 | 7/2008 | Lauderdale et al. | |
| 7,409,996 | B2 | 8/2008 | Myerley et al. | |
| 7,552,774 | B2 | 6/2009 | Anderson et al. | |
| 7,597,149 | B2 | 10/2009 | Williamson, Jr. et al. | |
| 7,631,664 | B1 | 12/2009 | Mailand | |
| 7,640,989 | B2 | 1/2010 | Williamson, Jr. et al. | |
| 7,775,269 | B2 | 8/2010 | Dennistoun et al. | |
| 7,896,082 | B2 | 3/2011 | Lake et al. | |
| 7,918,280 | B2 | 4/2011 | Mailand et al. | |
| 7,971,651 | B2 | 7/2011 | Tanju et al. | |
| 7,971,652 | B2 | 7/2011 | Tanju | |
| 8,002,042 | B2 | 8/2011 | Going, III | |
| 8,186,439 | B2 | 5/2012 | Lauderdale | |
| 8,662,187 | B2 | 3/2014 | Lake et al. | |
| 8,668,014 | B2 | 3/2014 | Mailand | |
| 8,960,298 | B2 | 2/2015 | Hill, Jr. et al. | |
| 9,103,184 | B2 | 8/2015 | Hill, Jr. et al. | |
| 9,133,688 | B2 | 9/2015 | Jancha et al. | |
| 9,217,312 | B2 | 12/2015 | Hill, Jr. et al. | |
| 9,334,709 | B2 | 5/2016 | Hill, Jr. et al. | |
| 9,441,456 | B2 | 9/2016 | Hill, Jr. et al. | |
| 9,523,260 | B2 | 12/2016 | Mailand et al. | |
| 9,624,755 | B2 | 4/2017 | Hill, Jr. et al. | |
| 9,638,006 | B2 | 5/2017 | Henschel et al. | |
| 9,771,777 | B2 | 9/2017 | Hill, Jr. et al. | |
| 9,920,593 | B2 | 3/2018 | Mailand et al. | |
| 10,018,022 | B2 | 7/2018 | Mailand et al. | |
| 10,030,476 | B2 | 7/2018 | Hill et al. | |
| 10,053,936 | B2 | 8/2018 | Herod et al. | |
| 10,100,611 | B2 | 10/2018 | Hill, Jr. et al. | |
| 10,119,375 | B1 | 11/2018 | Hill, Jr. | |
| 10,267,099 | B2 | 4/2019 | Mailand et al. | |
| 2002/0074129 | A1 | 6/2002 | Moore | |
| 2002/0108747 | A1 | 8/2002 | Dietz et al. | |
| 2002/0150436 | A1 | 10/2002 | Mason et al. | |
| 2004/0045714 | A1 | 3/2004 | McGavern et al. | |
| 2004/0069496 | A1 | 4/2004 | Hosie et al. | |
| 2004/0129423 | A1 | 7/2004 | Eddison | |
| 2004/0173362 | A1 | 9/2004 | Waithman et al. | |
| 2007/0187107 | A1 | 8/2007 | Pringle | |
| 2008/0314599 | A1 | 12/2008 | Bane et al. | |
| 2009/0008102 | A1 | 1/2009 | Anderson et al. | |
| 2009/0032237 | A1 | 2/2009 | Bane et al. | |
| 2009/0071654 | A1 | 3/2009 | O'Malley et al. | |
| 2009/0151924 | A1 | 6/2009 | Lake | |
| 2009/0250206 | A1 | 10/2009 | Lake et al. | |
| 2010/0108324 | A1 | 5/2010 | Tanju | |
| 2011/0037004 | A1 | 2/2011 | Lake et al. | |
| 2011/0120727 | A1 | 5/2011 | Lake et al. | |
| 2011/0186303 | A1 | 8/2011 | Scott et al. | |
| 2012/0006553 | A1 | 1/2012 | Korkmaz | |
| 2012/0032099 | A1 | 2/2012 | Vick, Jr. | |
| 2012/0067594 | A1 | 3/2012 | Noske et al. | |
| 2012/0312540 | A1 | 12/2012 | Lefebvre | |
| 2015/0083430 | A1 | 3/2015 | Jahnke et al. | |
| 2016/0265309 | A1 | 9/2016 | Vick | |

OTHER PUBLICATIONS

PCT Written Opinion of the International Search Authority (USPTO) for PCT International Application PCT/US2019/065135, filed Dec. 9, 2019, dated Feb. 25, 2020.

Mazerov, Katie, Re-inventing subsea intervention to keep economics above water, Sep. 21, 2011, Drilling Contractor Magazine, retrieved from https://www.drillingcontractor.org/re-inventing-subsea-intervention-to-keep-economics-above-water-10657 on Mar. 30, 2020.

Paschoa, Claudio, Riserless Light Well Intervention for Deepwater Wells, Feb. 24, 2014, Marine Technology News, retrieved from

(56) References Cited

OTHER PUBLICATIONS https://www.marinetechnologynews.com/blogs/riserless-light-well-intervention-for-deepwater-wells-700455 on Mar. 30, 2020.
PCT International Search Report for PCT International Application PCT/US2019/046283, filed Aug. 13, 2019, dated Jan. 23, 2020.
PCT Written Opinion of the International Search Authority (USPTO) for PCT International Application PCT/US2019/046283, filed Aug. 13, 2019, dated Jan. 23, 2020.
Reply to office action in U.S. Appl. No. 16/386,624, filed Apr. 17, 2019, dated Aug. 28, 2020.
Unknown authors, Deepwater Wells—Global Industry Response Group Recommendations, IOGP Report 463, International Association of Oil and Gas Producers, retrieved from https://www.iogp.org/bookstore/product/deepwater-wells-global-industry-response-group-recommendations/ on Mar. 30, 2020.
USPTO non-final office action issued in U.S. Appl. No. 16/386,624, filed Apr. 17, 2019, dated Jun. 16, 2020.

* cited by examiner 100
102
104
106
108
110
112
114
116
118
120
122
124
126
128a
130
132
134
136
137
137
137
138
138
140
142
144
146
148
150
152
154
156
156
158
160
162
164
166
168

SURFACE CONTROLLED WIRELINE RETRIEVABLE SAFETY VALVE

CROSS-REFERENCE TO RELATED APPLICATIONS

This application claims the benefit of, or priority to, U.S. Provisional Patent Application Ser. No. 62/779,121, filed on Dec. 13, 2018, which is hereby incorporated by reference in its entirety.

BACKGROUND OF THE INVENTION

A subterranean safety valve is a type of failsafe device configured to prevent catastrophic failure by shutting-in a well when other means of control are compromised. While typically required in offshore wells, such safety valves are increasingly finding application in onshore, or land-based, wells where positive control of the well is desirable due to the threat of unexpected failures, vandalism, terrorism, or even theft. Subterranean safety valves are more easily installed when the well is initially being completed. Conventionally, a tubing-retrievable safety valve is run into the well while the drilling rig is on the wellsite. The tubing-retrievable safety valve is typically deployed in the annular space between the well casing and the production tubing. During production activities, the safety valve is hydraulically actuated into the open, or producing, state by a surface-based pump that communicates hydraulic pressure, via a port of the wellhead, to the safety valve deployed in the well. When the hydraulic pressure is removed, the safety valve closes. However, in some instances, when the use of a safety valve is not contemplated in advance, the well may already be drilled, completed, and may even have been producing for a period of time. At this point, it is difficult to install a safety valve because the drilling rig is typically no longer onsite, the wellhead has no paths of hydraulic communication, and the production tubing is already deployed within the well. While re-completing the well may be possible, it can be logistically and cost prohibitive and is rarely done in the field for that reason. Since the Deepwater Horizon incident, many operators are now requiring the use of safety valves in all wells, including land-based wells. However, the tubing-retrievable safety valves conventionally used are prone to failure over time, presenting a substantial risk to the safety of personnel and the environment.

BRIEF SUMMARY OF THE INVENTION

According to one aspect of one or more embodiments of the present invention, a surface-controlled wireline-retrievable safety valve includes a seat housing having a plurality of flow ports that is configured to house a hard seat. A closure device has a plurality of equalization ports, is disposed within the seat housing, and is configured to controllably move off the hard seat and expose the plurality of flow ports to a central lumen of the safety valve under hydraulic actuation. A power piston having a shoulder portion is attached to the closure device and the shoulder portion is disposed within a hydraulic chamber housing forming a differential area. A hydraulic actuation port may be configured to receive hydraulic actuation fluid from a surface pump. A hydraulic passage may be configured to convey the hydraulic actuation fluid from the hydraulic actuation port to the differential area via a hydraulic access port. Under hydraulic actuation, hydraulic fluid in the differential area causes the power piston to compress the power spring and move the closure device off the hard seat exposing the plurality of flow ports to the central lumen of the safety valve.

Other aspects of the present invention will be apparent from the following description and claims.

DETAILED DESCRIPTION OF THE INVENTION

Figure 1A:
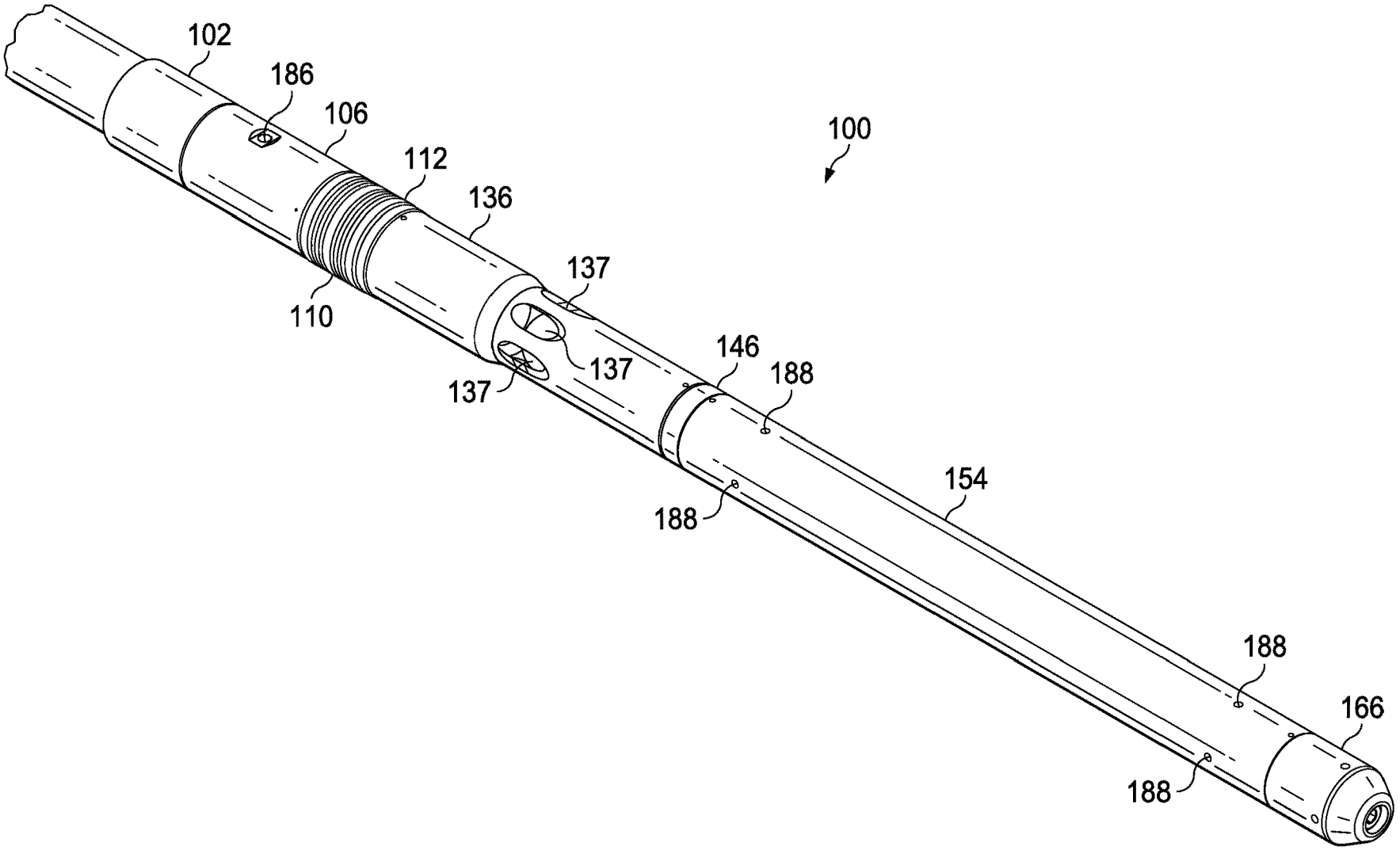
FIG. 1A shows a perspective view of a surface-controlled wireline-retrievable safety valve in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention. For purposes of clarity, as used herein, top or upper refer to a portion or side that is closer, whether directly or in reference to another component, to the surface above a wellbore and bottom or lower refer to a portion or side that is closer, whether directly or in reference to another component, to the bottom of the wellbore.

For safety and environmental reasons, a conventional downhole safety valve is typically installed during initial completion activities as a failsafe device configured to fail in the closed state such that production flow is halted whenever positively applied hydraulic actuation from the surface is removed. When a tubing-retrievable safety valve deployed within a well fails, for whatever reason, production is halted, and the operator may re-complete the well at substantial expense or run a wireline-retrievable safety valve into an inner diameter of the failed tubing-retrievable safety valve in an effort to safely continue production, albeit possibly at a reduced flow rate. A conventional wireline-retrievable safety valve may be run into the well on a lock that locates the wireline-retrievable safety valve within a desired location of the failed tubing-retrievable safety valve. The conventional wireline-retrievable safety valve typically includes packing elements that isolate the original hydraulic actuation used to control the tubing-retrievable safety valve. The process of opening up the original hydraulic actuation of the tubing-retrievable safety valve for use with the wireline-retrievable safety valve is typically referred to as communication. Communication is typically performed by cutting, punching, shifting sleeves, breaking hydraulic fittings, or other such means that are well-known in the industry and are not discussed herein. Once hydraulic communication has been achieved, a surface-driven pump is used to pump hydraulic actuation fluid through the original hydraulic actuation passage of the tubing-retrievable safety valve to the wireline-retrievable safety valve to hydraulically actuate the wireline-retrievable safety valve. While the conventional wireline-retrievable safety valve reduces the flow rate of production fluids, it allows such wells to continue producing after failure of the tubing-retrievable safety valve without the attendant cost of an expensive re-completion. As previously discussed, the conventional wireline-retrievable safety valve is a failsafe device that is closed by default and requires the positive application of hydraulic pressure to open a flapper that permits production flow through the safety valve. In the event of a failure or catastrophic event, once the hydraulic actuation is lost, the energy stored in a power spring disposed above the flapper of the wireline-retrievable safety valve causes the safety valve to close, thereby safely halting production.

However, conventional wireline-retrievable safety valves have a number of shortcomings that are problematic. For example, because of the design of conventional wireline-retrievable safety valves, the requirement for a large inner diameter and thus higher production limits the amount of space available above the flapper in the top part of the safety valve to package stored energy, typically in the form of a power spring. As such, the amount of stored energy, which is used to offset the increased hydraulic head pressure, limits the depth setting of the wireline-retrievable safety valve within the well. Moreover, even if the stored energy above the flapper in the top part of the safety valve were sufficient to overcome the increased hydraulic head pressure with increased depth, it would necessitate a reduction in the inner diameter of the safety valve, which would result in substantially reduced production flow rates. In addition, conventional wireline-retrievable safety valves use a soft seat to ensure that the flapper forms a proper seal that halts production flow. Soft seats are prone to failure over time resulting in leakage that could result in catastrophic failure of the safety valve. In addition, conventional wireline-retrievable safety valves are constrained by the depth in which they may be deployed and actuated. As discussed above, conventional wireline-retrievable safety valves require the positive application of hydraulic pressure to compress a power spring disposed above the flapper to controllably open the safety valve when production flow is desired. If the safety valve is deployed at a depth that exceeds the ability of the hydraulic actuation to overcome the hydrostatic head pressure to compress the power spring disposed above the flapper, the safety valve cannot be opened, thereby preventing production flow. In an effort to increase the installation depth at which such conventional safety valves may operate, various flapper, equalizing darts, and equalizing dart spring designs have been developed that attempt to reduce the amount of hydraulic actuation required to open the safety valve. Notwithstanding, conventional wireline-retrievable safety valves remain limited at the depth at which they may be deployed.

Accordingly, in one or more embodiments of the present invention, a surface-controlled wireline-retrievable safety valve stores the energy used to close the closure device of the safety valve below the closure device. This allows for a significant increase in the potential stored energy that can be incorporated into the valve. This additional stored energy may be used to offset the increased hydraulic head pressure at depth, therefore enabling use of the safety valve at greater depths than conventional safety valves that store the potential energy above the closure device in the top part of the safety valve. In addition, hydraulic differential pressure across the closure device from below is more robustly and automatically equalized than conventional flapper equalization designs that have low seating forces. The seating force of the equalization ports of the claimed invention, when the safety valve closes, is driven by the force of the stored potential energy, or compressed power spring, rather than a low force flapper dart spring typically found in conventional wireline-retrievable safety valves. Advantageously, the surface-controlled wireline-retrievable safety valve may be run deeper than conventional wireline-retrievable safety valves because the hydraulic actuation required to actuate the safety valve is reduced as compared to conventional wireline-retrievable safety valves. In addition, because there is never a need to go through the safety valve with auxiliary tools during operation, the power spring may be disposed below the closure device which, in addition to providing increased installation depth, substantially improves the production flow rate achieved. The design of the closure device eliminates the need for a soft seat and a flapper, further improving the quality and productive life of the seal achieved.

FIG. 1A shows a perspective view of a surface-controlled wireline-retrievable safety valve 100 in accordance with one or more embodiments of the present invention. Surface-controlled wireline-retrievable safety valve 100 may include a spacer 102 attached to a top distal end of an adapter sub 106. Spacer 102 may include, for example, threaded ends (not independently shown) to facilitate top and bottom connections. Spacer 102 may be sized to properly position safety valve 100 within a failed tubing-retrievable safety valve (not shown) to facilitate hydraulic communication (not shown) through the tubing-retrievable safety valve (not shown) and production fluid flow (not shown) through a central lumen of the tubing-retrievable safety valve (not shown) when safety valve 100 is actuated. For example, spacer 102 may ensure alignment of a hydraulic actuation port 186 of adapter sub 106 with the original hydraulic actuation (not shown) of the tubing-retrievable safety valve (not shown) and ensure that the flapper is held in the open position. As such, the length of spacer 102 may vary based on an application or design as well as with the type or kind of tubing-retrievable safety valve (not shown) that the safety valve 100 interfaces with. One of ordinary skill in the art will recognize that spacer 102 may vary in length and may not be required in all applications. Adapter sub 106 may have a top distal end with a threaded connection (not shown) that is configured to attach to spacer 102 and a bottom distal end with a threaded connection (not shown) that is configured to attach to packer housing 112 with a lower packing 110 disposed about a portion of packer housing 112. Lower packing 110 may be used in conjunction with an upper packing (not shown) to isolate the original hydraulic actuation (not shown) of the failed tubing-retrievable safety valve (not shown) to facilitate opening up hydraulic communication for use by safety valve 100. The hydraulic actuation port 186 of adapter sub 106 disposed in between the upper packing (not shown) and lower packing 112 may be configured to receive hydraulic actuation fluid (not shown) from a surface pump (not shown) by way of the opened-up original hydraulic actuation (not shown) of the failed tubing-retrievable safety valve (not shown). Hydraulic actuation fluid (not shown) may be conveyed from hydraulic actuation port 186 to a differential area (not shown) within a hydraulic chamber (not shown) as discussed in more detail herein via a hydraulic passage (not shown).

Figure 1B:
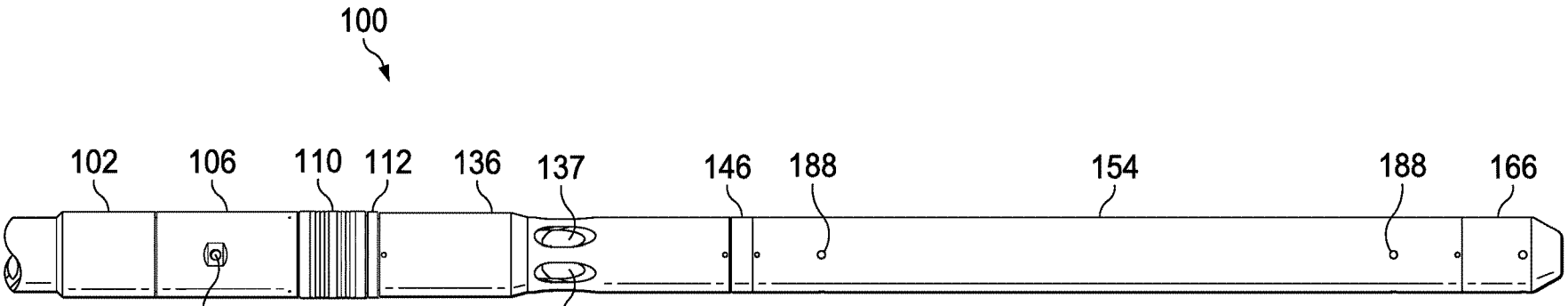
FIG. 1B shows a top elevation view of the surface-controlled wireline-retrievable safety valve in accordance with one or more embodiments of the present invention.
Figure 1C:
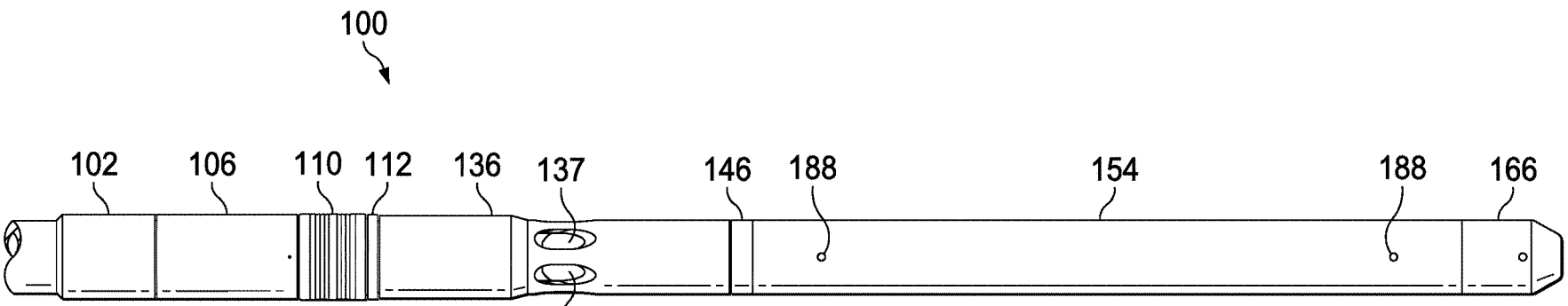
FIG. 1C shows a bottom elevation view of the surface-controlled wireline-retrievable safety valve in accordance with one or more embodiments of the present invention.
Figure 1D:
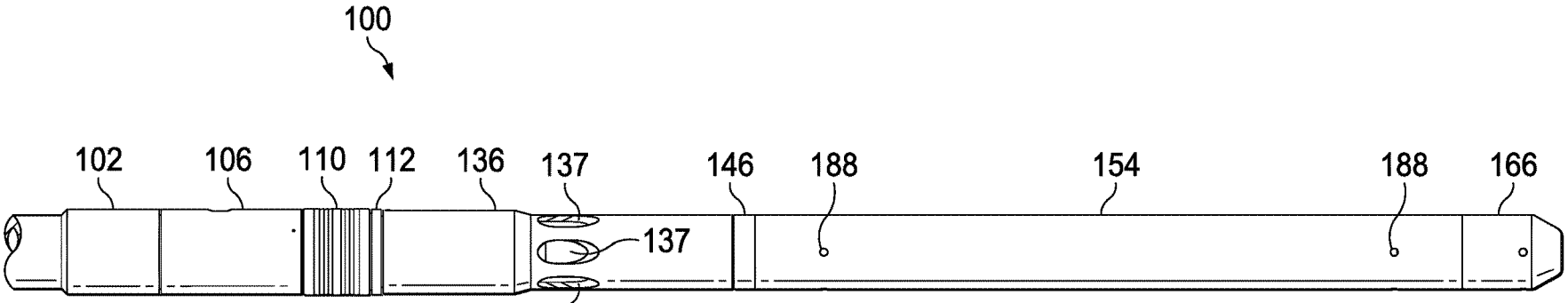
FIG. 1D shows a left elevation view of the surface-controlled wireline-retrievable safety valve in accordance with one or more embodiments of the present invention.
Figure 1E:
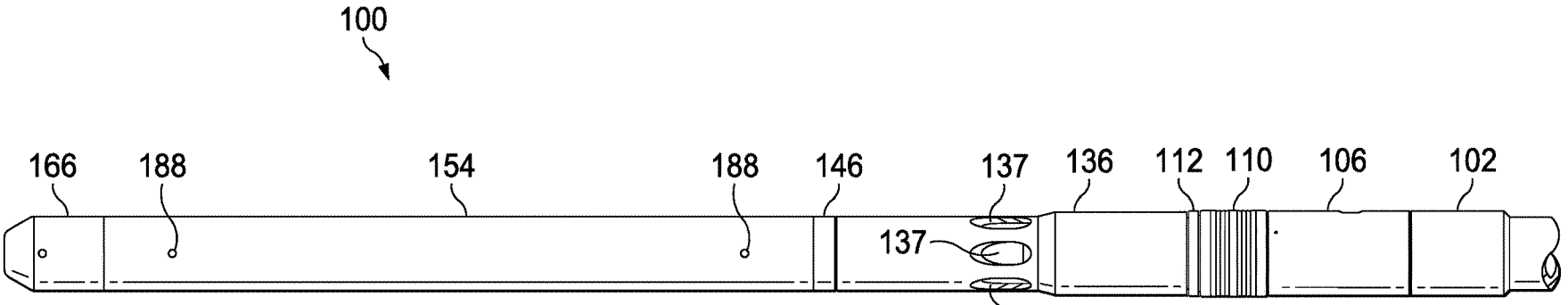
FIG. 1E shows a right elevation view of the surface-controlled wireline-retrievable safety valve in accordance with one or more embodiments of the present invention.
Figure 1G:
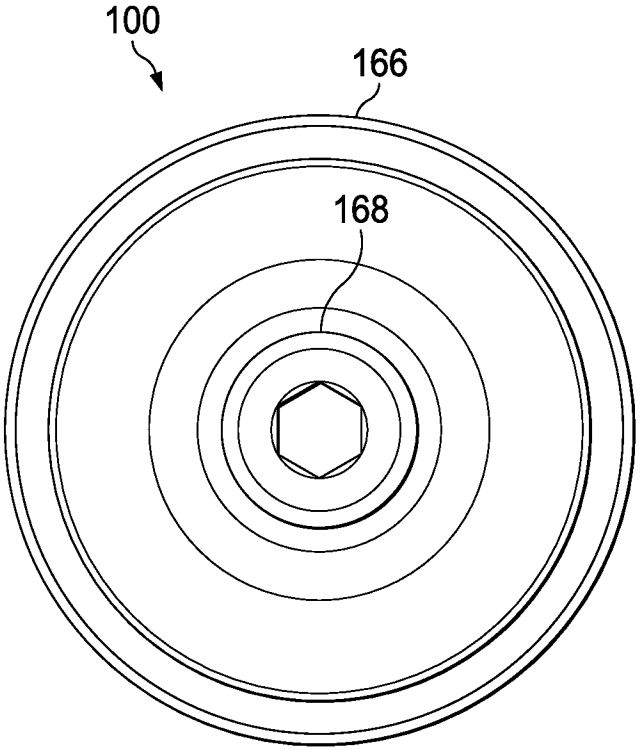
FIG. 1G shows a bottom plan view of the surface-controlled wireline-retrievable safety valve in accordance with one or more embodiments of the present invention.
Figure 1F:
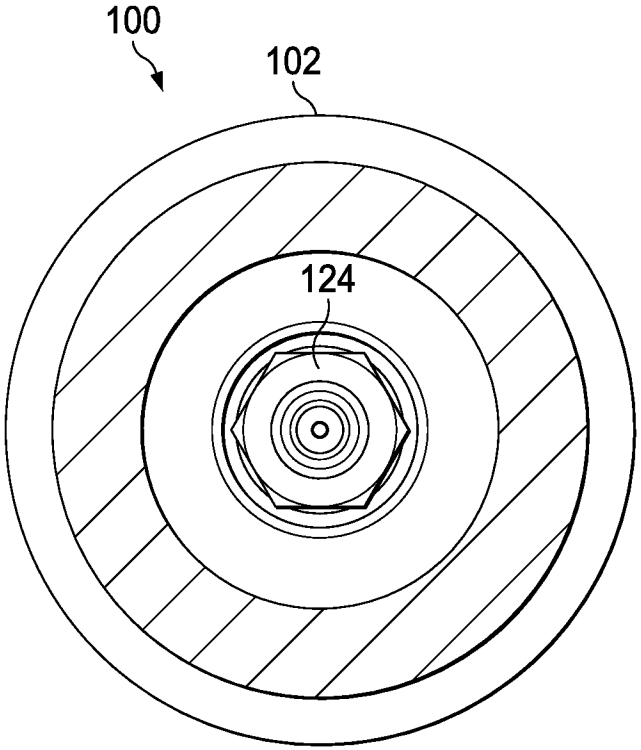
FIG. 1F shows a top plan view of the surface-controlled wireline-retrievable safety valve in accordance with one or more embodiments of the present invention.

Safety valve 100 may include a seat housing 136 having a plurality of flow ports 137 disposed about an outer surface. Seat housing 136 may house a hard seat (not shown), a closure device (not shown), and portions of a power piston (not shown). When safety valve 100 is deployed within a failed tubing-retrievable safety-valve (not shown) and hydraulically actuated (not shown), production fluids flow in an annulus between the production tubing (not shown) and safety valve 100, enter a central lumen (not shown) of safety valve 100 via the plurality of flow ports 137, and are communicated to the surface through a central lumen (not shown) of the failed tubing-retrievable safety valve (not shown). Safety valve 100 may include a hydraulic chamber housing 146 having a top side attached to a bottom distal end of seat housing 136 and a bottom side attached to a top side of a spring housing 154. Hydraulic chamber housing 146 facilitates hydraulic actuation of safety valve 100 as discussed in more detail herein. Spring housing 154 houses a power spring (not shown) that is disposed below the closure device (not shown) of safety valve 100. Safety valve 100 may also include a nose housing 166 having a top distal end attached to a bottom distal end of spring housing 154 and a bottom distal end having a chamfered shape to facilitate insertion. Continuing, FIG. 1B shows a top elevation view, FIG. 1C shows a bottom elevation view, FIG. 1D shows a left elevation view, FIG. 1E shows a right elevation view, FIG. 1F shows a top plan view, and FIG. 1G shows a bottom plan view of the surface-controlled wireline-retrievable safety valve 100 in accordance with one or more embodiments of the present invention.

Figures 2A, 2B, 2C:
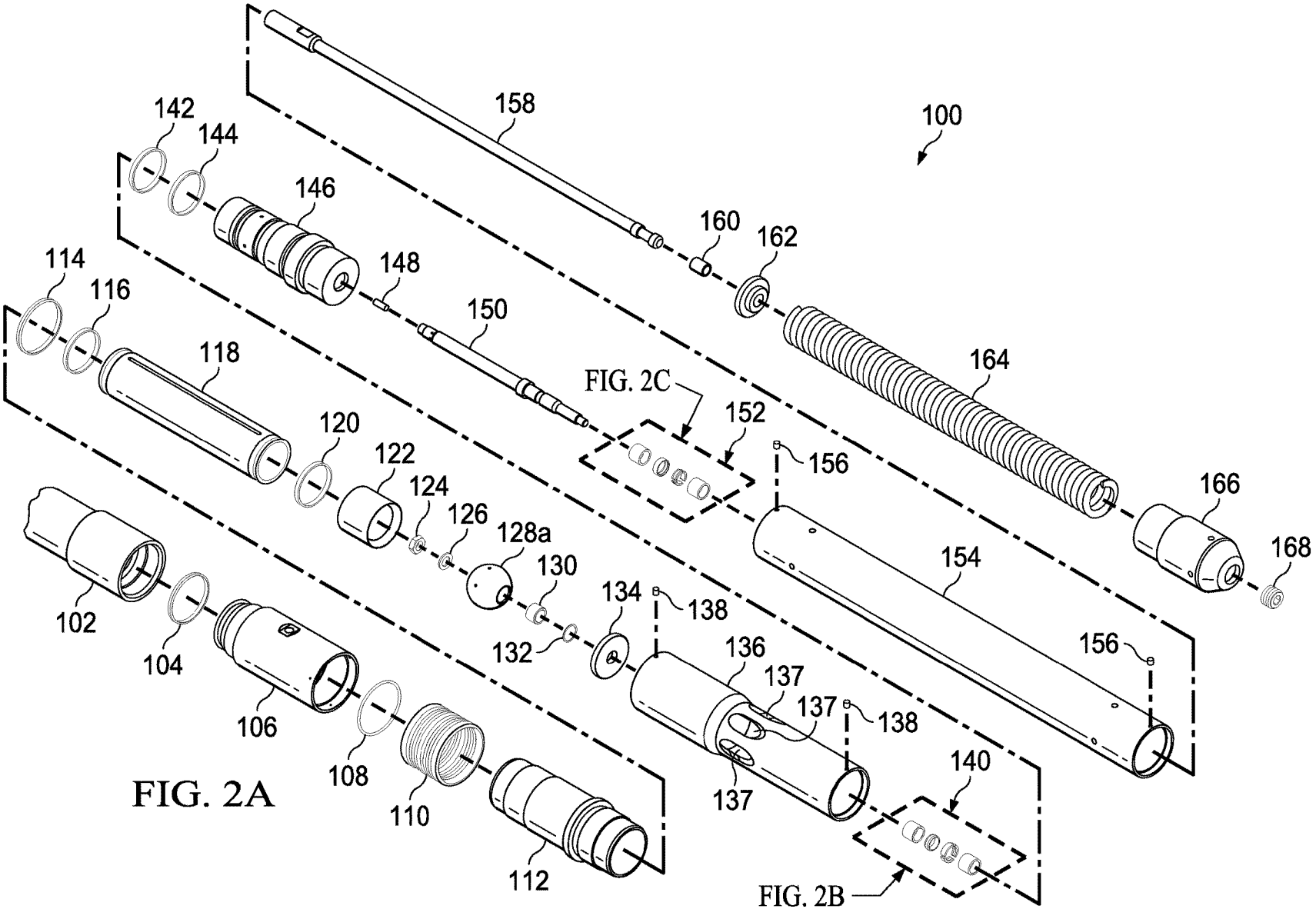
FIG. 2A shows an exploded perspective view of a surface-controlled wireline-retrievable safety valve in accordance with one or more embodiments of the present invention.
FIG. 2B shows a detailed exploded view of an upper power seal stack of the surface-controlled wireline-retrievable safety valve in accordance with one or more embodiments of the present invention.
FIG. 2C shows a detailed exploded view of a lower power seal stack of the surface-controlled wireline-retrievable safety valve in accordance with one or more embodiments of the present invention.
Figure 2B:
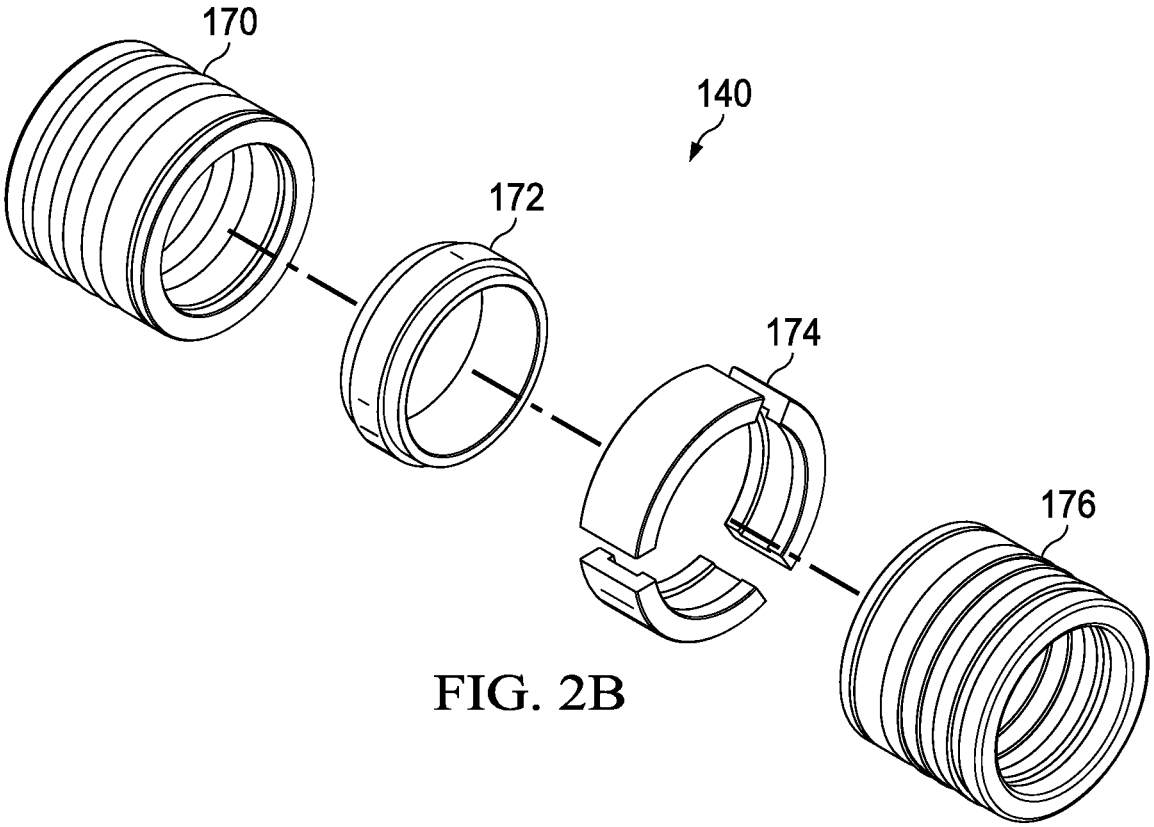
Figure 2C:
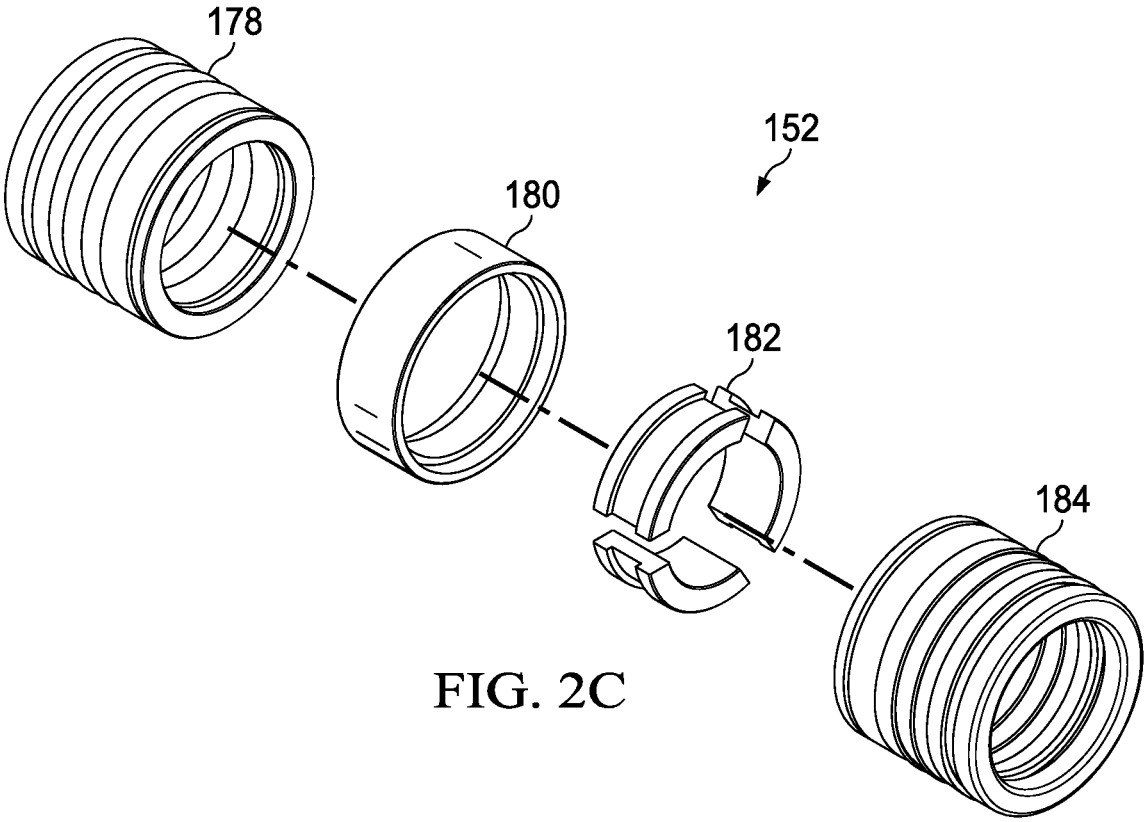

FIG. 2A shows an exploded perspective view of a surface-controlled wireline-retrievable safety valve 100 in accordance with one or more embodiments of the present invention. In this exploded perspective view, the orientation of the various components as well as the manner of assembly are shown or suggested. Surface-controlled wireline-retrievable safety valve 100 may include a spacer 102, an O-ring with backup 104, an adapter sub 106, an O-ring 108, a lower packing 110, a packing housing 112, an O-ring with backup 114, an O-ring with backup 116, and an inner sleeve 118. Inner sleeve 118 may be disposed within adapter sub 106, packing housing 112, and seating housing 136. Safety valve 100 may also include an O-ring with backup 120, a hard seat 122, a retaining nut 124, a retaining washer 126, a closure device 128*a*, a bushing 130, a bushing retainer 132, a seat housing 136, and a plurality of set screws 138. Hard seat 122 may be disposed within seat housing 136 and configured to serve as a hard stop for the closure device 128*a*, when on seat 122 and safety valve 100 is in the closed state. In certain embodiments, where the closure device 128 is a ball 128*a*, hard seat 122 may include a conical section configured to receive ball 128*a*. Safety valve 100 may also include an upper power seal stack 140, a double O-ring 142, a double O-ring 144, a hydraulic chamber housing 146, a bushing 148, an upper power piston 150, and a lower power seal stack 152.

Upper power piston 150 may be partially disposed within hydraulic chamber housing 146 having a top distal end that is secured to closure device 128 by retaining nut 124. Upper power seal stack 140 and lower power seal stack 152 may be disposed about upper power piston 150 and configured to facilitate hydraulic actuation (not shown) as discussed in more detail herein. Safety valve 100 may include a spring housing 154, a plurality of set screws 156, a lower power piston 158, a bushing 160, a spring ring 162, a power spring 164, a nose housing 166, and a nose plug 168. Power spring 164 may be disposed below the closure device 128, ball 128*a* in the depicted embodiment, such that the energy stored to close safety valve 100 is disposed below the closure device itself. One of ordinary skill in the art will recognize that one or more of the above-noted components may be added, subtracted, combined, or otherwise modified from what is depicted in the figure in accordance with one or more embodiments of the present invention. For example, other types or kinds of closure devices 128 may be used in place of ball 128*a*, including, but not limited to, a poppet (e.g., 128*b*) or other cone-ended cylinder and seat (not shown). However, in all such embodiments, the energy used to close the closure device 128 shall be disposed below the closure device 128.

In certain embodiments, the power piston may include an upper power piston 150 and lower power piston 158 that may be attached to one another to facilitate assembly of valve 100. In other embodiments, the power piston may include a unibody member that may be, for example, simply the combination of upper power piston 150 and lower power piston 158 in a unibody embodiment. For the purposes of this disclosure, reference to an upper power piston 150, lower power piston 158, or power piston may refer to either multi-part or unibody power piston embodiments and reference to upper power piston 150 and lower power piston 158 apply in the same manner to unibody power piston embodiments that is simply a combination of upper power piston 150 and lower power piston 158. SpecifOne of ordinary skill in the art will recognize that the size, shape, and configuration of the power piston may vary based on an application or design in accordance with one or more embodiments of the present invention.

Continuing, FIG. 2B shows a detailed exploded view of an upper power seal stack 140 of the surface-controlled wireline-retrievable safety valve 100 in accordance with one or more embodiments of the present invention. Upper power seal stack 140 may include an upper seal stack 170, a seal glide ring 172, a seal load ring 174, and a lower seal stack 176. Continuing, FIG. 2C shows a detailed exploded view of a lower power seal stack 152 of the surface-controlled wireline-retrievable safety valve 100 in accordance with one or more embodiments of the present invention. Lower power seal stack 152 may include an upper seal stack 178, a seal glide ring 180, a seal load ring 182, and a lower seal stack 184.

Figure 3:
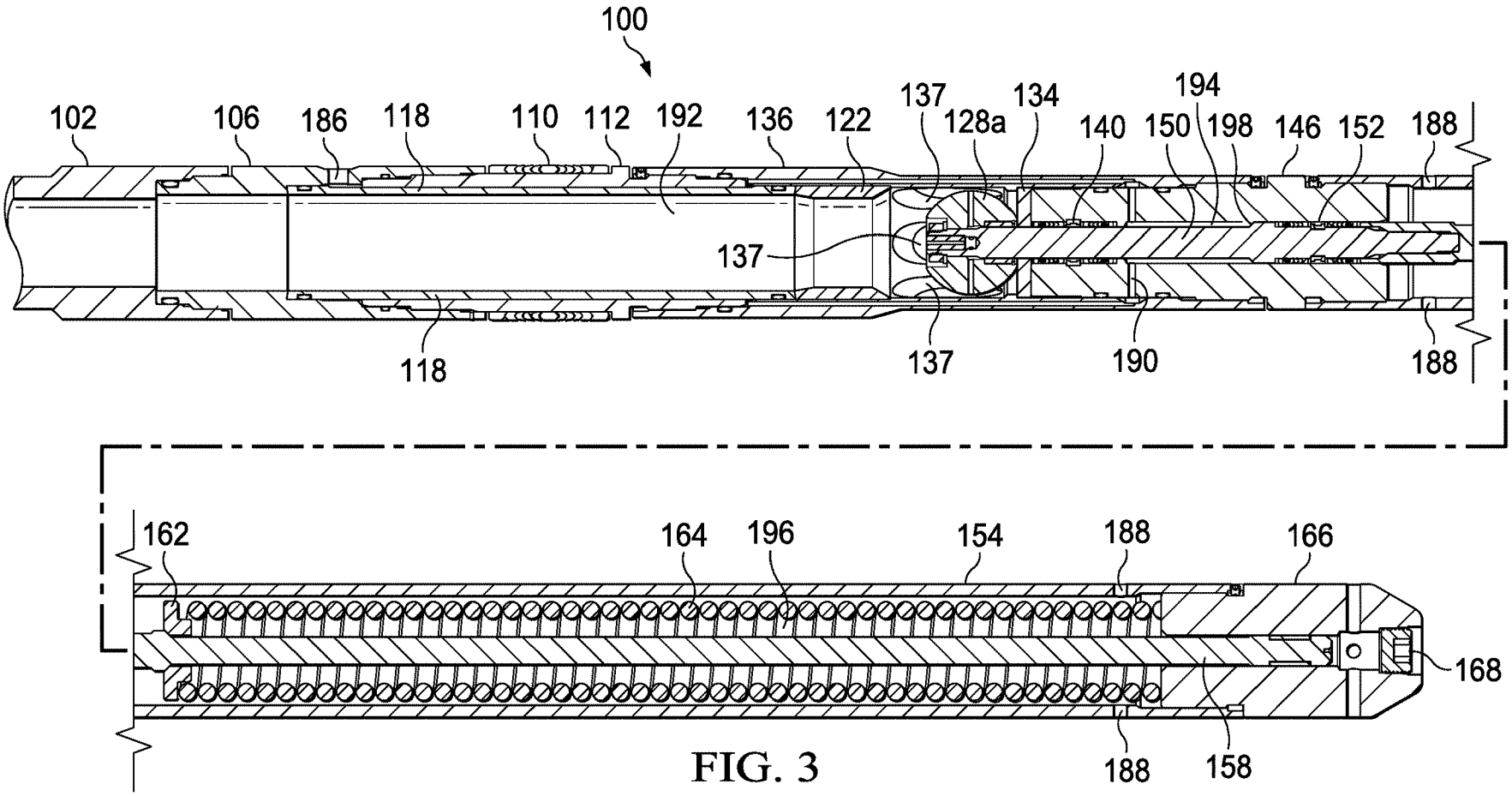
FIG. 3 shows a cross-sectional view of a surface-controlled wireline-retrievable safety valve in accordance with one or more embodiments of the present invention.

FIG. 3 shows a cross-sectional view of a surface-controlled wireline-retrievable safety valve 100 in accordance with one or more embodiments of the present invention. Safety valve 100 may include a spacer 102 attached to a top end of an adapter sub 106. As previously discussed, spacer 102 may be used to properly position safety valve 100 within a failed tubing-retrievable safety valve (not shown). Spacer 102 may position adapter sub 106 such that a hydraulic actuation port 186 is positioned to receive hydraulic fluid (not shown) pumped downhole from the surface (not shown) that is communicated through the opened-up original hydraulic actuation (not shown) of the failed tubing-retrievable safety valve (not shown) when safety valve 100 is actuated.

A bottom end of adapter sub 106 may be attached to a top end of a packer housing 112. A lower packing 110 may be disposed about a portion of packing housing 112 below hydraulic actuation port 186, used in conjunction with an upper packing (not shown) disposed above hydraulic actuation port 186, to facilitate communication by opening up the original hydraulic actuation (not shown) path through the failed tubing-retrievable safety valve (not shown). An inner pressure sleeve 118 may be disposed within adapter sub 106, packing housing 112, and seat housing 136. Inner pressure sleeve 118, adapter sub 106, and spacer 102 of safety valve 100 may include a central lumen 192 through which production fluids (not shown) may flow when safety valve 100 is actuated. To actuate safety valve 100, hydraulic actuation fluid (not shown) received from hydraulic actuation port 186 of adapter sub 106 may be conveyed via a hydraulic passage (not independently illustrated) formed between inner pressure sleeve 118 and adapter sub 106, packer housing 112, and seat housing 136 to a hydraulic access port 190 to a differential area 194 formed within a hydraulic chamber housing 146. Safety valve 100 may include a hard seat 122 disposed within seat housing 136 that serves as a backdrop for the closure device 128, e.g., ball 128*a* in the depicted embodiment, when safety valve 100 is closed. Seat housing 136 may include a plurality of flow ports 137 and may be configured to house a hard seat 122. In certain embodiments, such as the one depicted in the figure, the plurality of flow ports 137 may be conical sections cutout from seat housing 136 having a shape and size configured to interface with the closure device 128, e.g., ball 128*a* here, but elongated such that the closure device 128, e.g., ball 128*a*, disposed within seat housing 136 may travel. Under hydraulic actuation (not shown), the closure device may be configured to controllably move off hard seat 122 and expose the plurality of flow ports 137 to a central lumen 192 of safety valve 100.

A top end of an upper power piston 150 may be attached to the closure device 128, e.g., ball 128*a*, and upper power piston 150 may include a shoulder portion 198 disposed within hydraulic chamber housing 146 forming differential area 194 therein. A top end of lower power piston 158 may be attached to a bottom end of upper power piston 150 and at least a portion of lower power piston 158 may be disposed within a central lumen 196 of power spring 164. An upper power seal stack 140 may be disposed within hydraulic chamber housing 146 about upper power piston 150 and above hydraulic access port 190. A lower power seal stack 152 may be disposed within hydraulic chamber housing 146 about upper power piston 150 and below hydraulic access port 190. Under hydraulic actuation (not shown), hydraulic fluid (not shown) in the differential area 194 causes the upper 150 and lower 158 power pistons to compress power spring 164 and move the closure device, e.g., ball 128, off the hard seat 122 exposing the plurality of flow ports 137 to the central lumen 192 of safety valve 100, thereby allowing production fluids (not shown) to flow to the surface (not shown). When hydraulic actuation (not shown) is removed, stored energy in power spring 164, disposed below the closure device 128, e.g., ball 128*a*, causes the closure device to move back on hard seat 122 and close the plurality of flow ports 137 off from production fluid (not shown) flow.

Figure 4A:
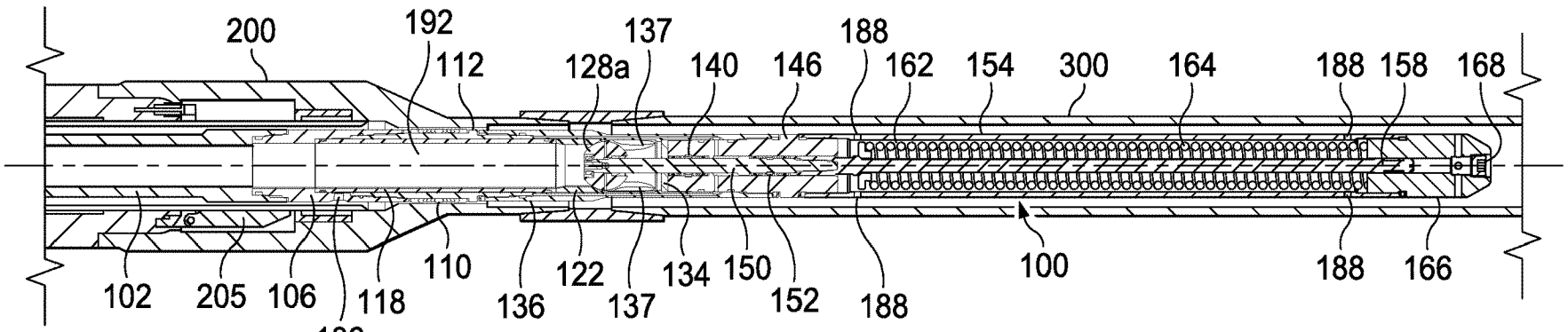
FIG. 4A shows a cross-sectional view of a surface-controlled wireline-retrievable safety valve disposed within a tubing-retrievable safety valve with the closure device in a closed position in accordance with one or more embodiments of the present invention.

FIG. 4A shows a cross-sectional view of a surface-controlled wireline-retrievable safety valve 100 disposed within a tubing-retrievable safety valve 200 with the closure device 128 in a closed position in accordance with one or more embodiments of the present invention. As previously discussed, a tubing-retrievable safety valve 200 is typically disposed within a wellbore (not shown) during initial completion. A bottom end of tubing-retrievable safety valve 200 may be attached, either directly or indirectly, to production tubing 300. When tubing-retrievable safety valve 200 fails, surface-controlled wireline-retrievable safety valve 100 may be deployed within an inner area of tubing-retrievable safety valve 200 and production tubing 300. A spacer 102 may be used to properly position safety valve 100 such that flapper 205 of tubing-retrievable safety valve 200 remains open and the original hydraulic actuation (not shown) that was opened up for communication is fluidly connected to hydraulic actuation port 186. An upper packing (not shown) and a lower packing 110 isolate the opened-up communication such that hydraulic actuation fluids provided from the surface (not shown) are directed to hydraulic actuation port 186 for use in actuating safety valve 100. In the environment of use depicted, there is no hydraulic actuation, such that power spring 164 causes the closure device 128, e.g., ball 128*a*, on hard seat 122, closing the plurality of flow ports 137 such that production fluid (not shown) are prevented from flowing through a central lumen 192 of safety valve 100.

Figure 4B:
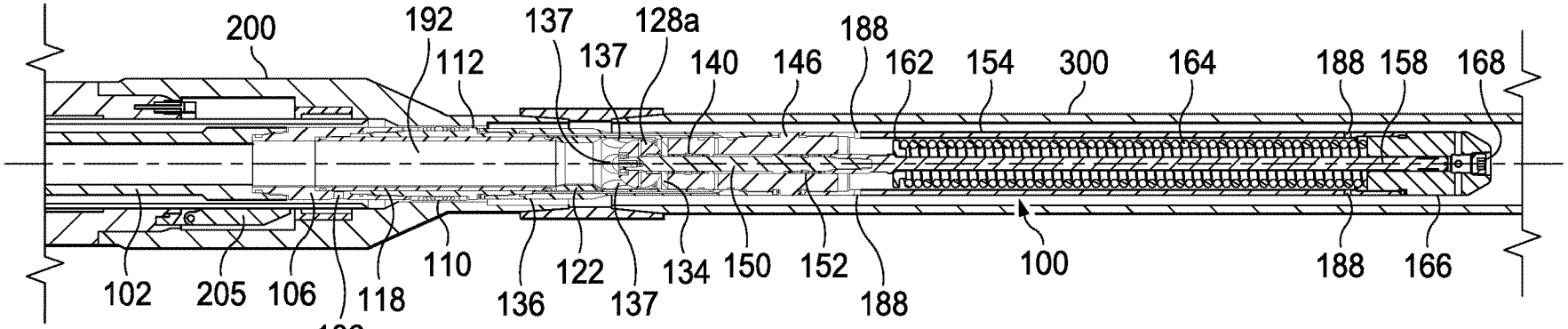
FIG. 4B shows a cross-sectional view of the surface-controlled wireline-retrievable safety valve disposed within the tubing-retrievable safety valve with the closure device in an opened position in accordance with one or more embodiments of the present invention.
Figure 4C:
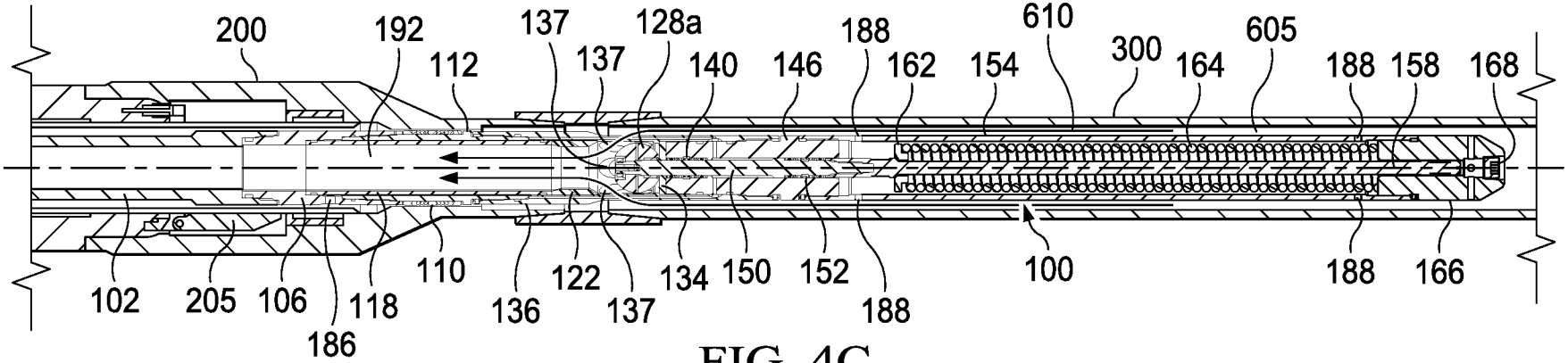
FIG. 4C shows a cross-sectional view of the surface-controlled wireline-retrievable safety valve disposed within the tubing-retrievable safety valve with the closure device in an opened position showing production flow in accordance with one or more embodiments of the present invention.

Continuing, FIG. 4B shows a cross-sectional view of the surface-controlled wireline-retrievable safety valve 100 disposed within the tubing-retrievable safety valve 200 with the closure device 128 in an opened position in accordance with one or more embodiments of the present invention. When under hydraulic actuation (not independently illustrated), the closure device 128, e.g., ball 128*a*, moves off hard seat 122 exposing the plurality of flow ports 137 allowing fluid communication from outside safety valve 100 through the plurality of flow ports 137 and into the central lumen 192 of safety valve 100. Continuing, FIG. 4C shows a cross-sectional view of the surface-controlled wireline-retrievable safety valve 100 disposed within the tubing-retrievable safety valve 200 with the closure device 128 in an opened position showing production flow 610 in accordance with one or more embodiments of the present invention. When hydraulically actuated, production fluids (not shown) in the annulus between safety valve 100 and production tubing 300 enters safety valve 100 via the plurality of flow ports 137 and are conveyed to the surface (not shown) via the central lumen 192 of safety valve 100.

Figure 5A:
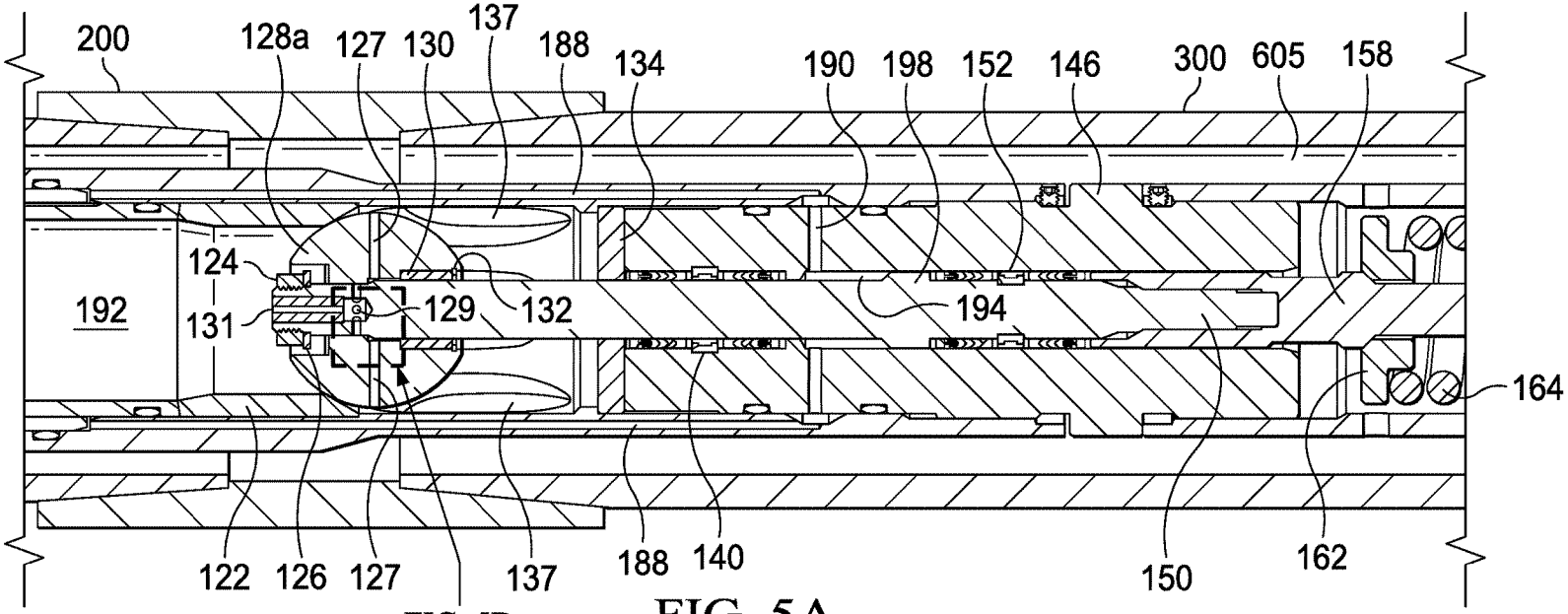
FIG. 5A shows a cross-sectional view of a portion of a surface-controlled wireline-retrievable safety valve disposed within a tubing-retrievable safety valve with the closure device in a closed position in accordance with one or more embodiments of the present invention.

FIG. 5A shows a cross-sectional view of a portion of a surface-controlled wireline-retrievable safety valve 100 disposed within a tubing-retrievable safety valve 200 with the closure device in a closed position in accordance with one or more embodiments of the present invention. As previously discussed, safety valve 100 is a failsafe device that, absent positive hydraulic actuation, returns to the closed state automatically using the energy stored in the power spring disposed below the closure device 128, e.g., ball 128*a*. Power spring 164 drives closure device 128, e.g., ball 128*a*, onto hard seat 122, such that the plurality of flow ports 137 are not fluidly connected with the central lumen 192 of safety valve 100.

Figure 5D:
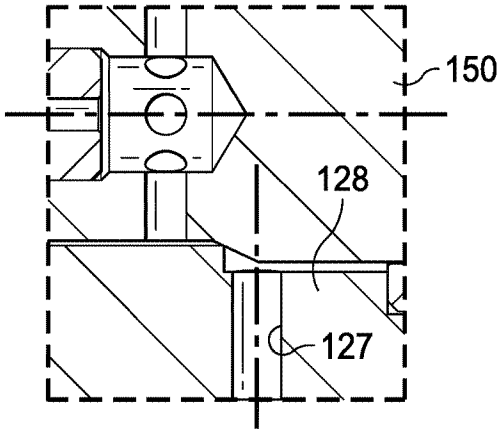
FIG. 5D shows a detail cross-sectional view of a ball and hard seat of the surface-controlled wireline-retrievable safety valve disposed within the tubing-retrievable safety valve with the closure device in an opened position in accordance with one or more embodiments of the present invention.
Figure 5B:
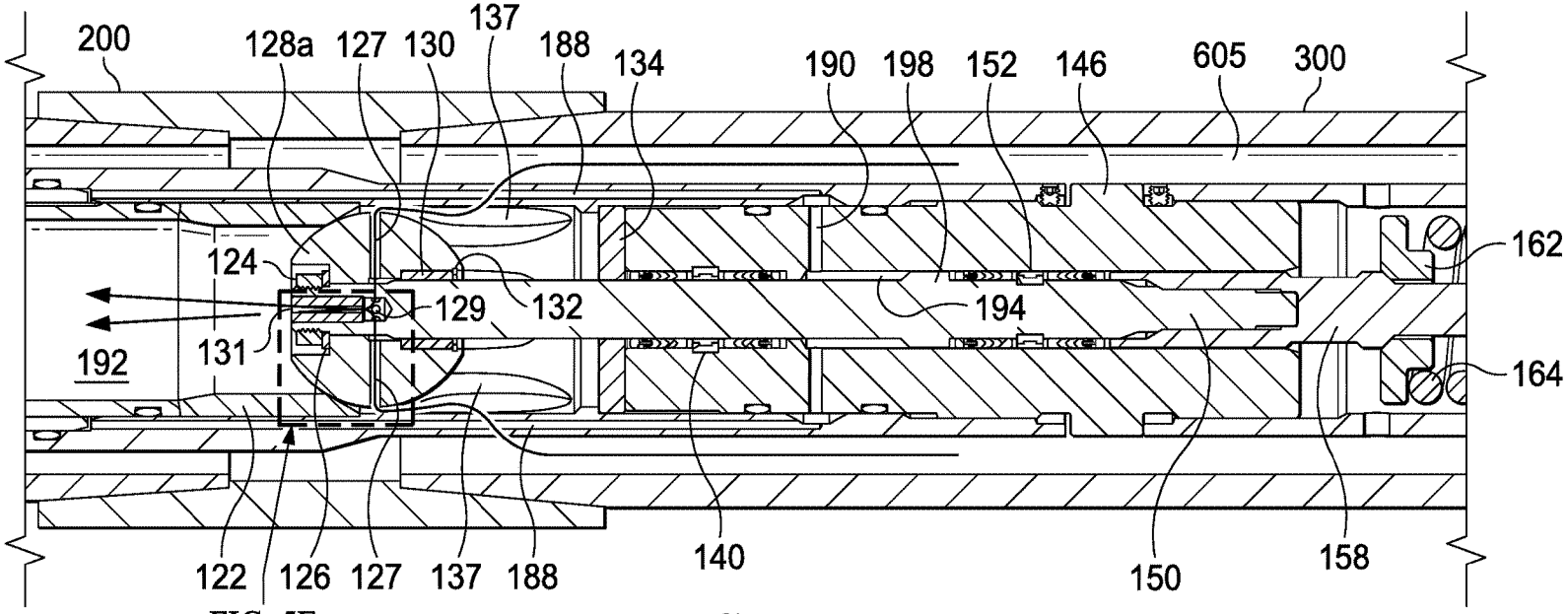
FIG. 5B shows a cross-sectional view of a portion of the surface-controlled wireline-retrievable safety valve disposed within the tubing-retrievable safety valve with pressure across the closure device equalizing in accordance with one or more embodiments of the present invention.
Figure 5E:
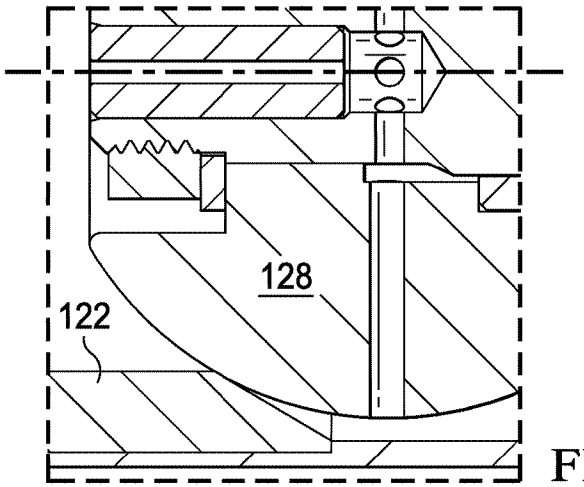
FIG. 5E shows a detail portion of FIG. 5B showing the closure device equalizing in accordance with one or more embodiments of the present specification.

Continuing, FIG. 5B shows a cross-sectional view of a portion of the surface-controlled wireline-retrievable safety valve 100 disposed within the tubing-retrievable safety valve 200 with pressure across the closure device equalizing in accordance with one or more embodiments of the present invention. Under hydraulic actuation, prior to the closure device 128, e.g., ball 128*a*, moving off hard seat 122, production fluids (not shown) entering the plurality of flow ports and around the metal-to-metal seal formed by ball 128*a* and upper power piston 150 near equalization port 127 of the closure device 128, e.g., ball 128*a*, to open allowing a plurality of equalization ports 127 of the closure device 128, e.g., ball 128*a*, in conjunction with piston equalization ports 129 and insert equalization port 131, to equalize the hydraulic pressure (not independently illustrated) across the closure device while it is still on hard seat 122. The equalization of hydraulic pressure across the closure device and the disposition of power spring 164 below the closure device allows safety valve 100 to be deployed at substantially deeper setting depths than conventional safety valves while still enabling hydraulic actuation from the surface. Hydraulic actuation fluid (not shown) received from hydraulic actuation port 186 are conveyed via hydraulic passage 188 to hydraulic access port 190. The hydraulic actuation fluid is then conveyed to the differential area 194 between hydraulic chamber housing 146, upper power piston 150, and shoulder portion 198 of upper power piston 150. In this view, the isolation role played by upper power seal stack 140 and lower power seal stack 152 is shown.

Figure 5C:
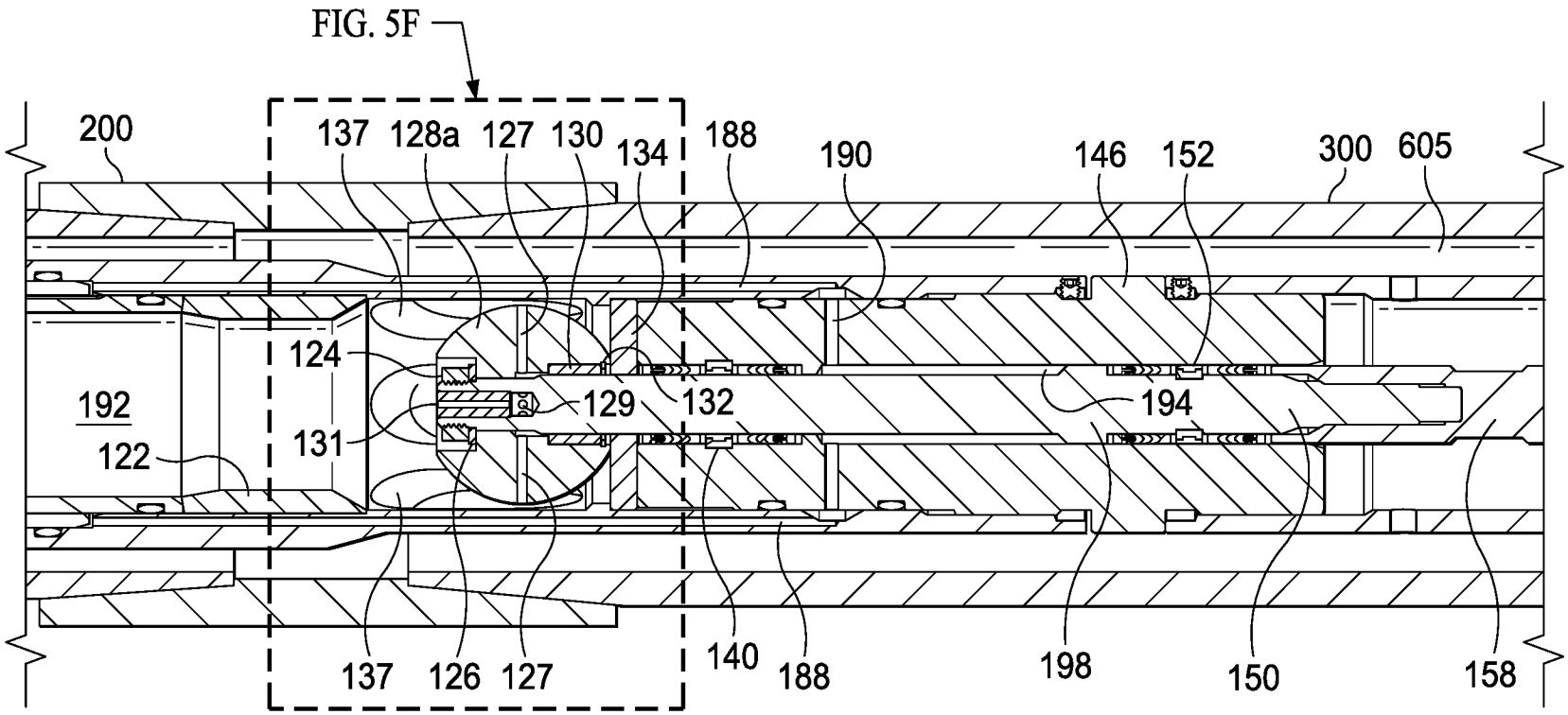
FIG. 5C shows a cross-sectional view of a portion of the surface-controlled wireline-retrievable safety valve disposed within the tubing-retrievable safety valve with the closure device in an opened position in accordance with one or more embodiments of the present invention.
Figure 5F:
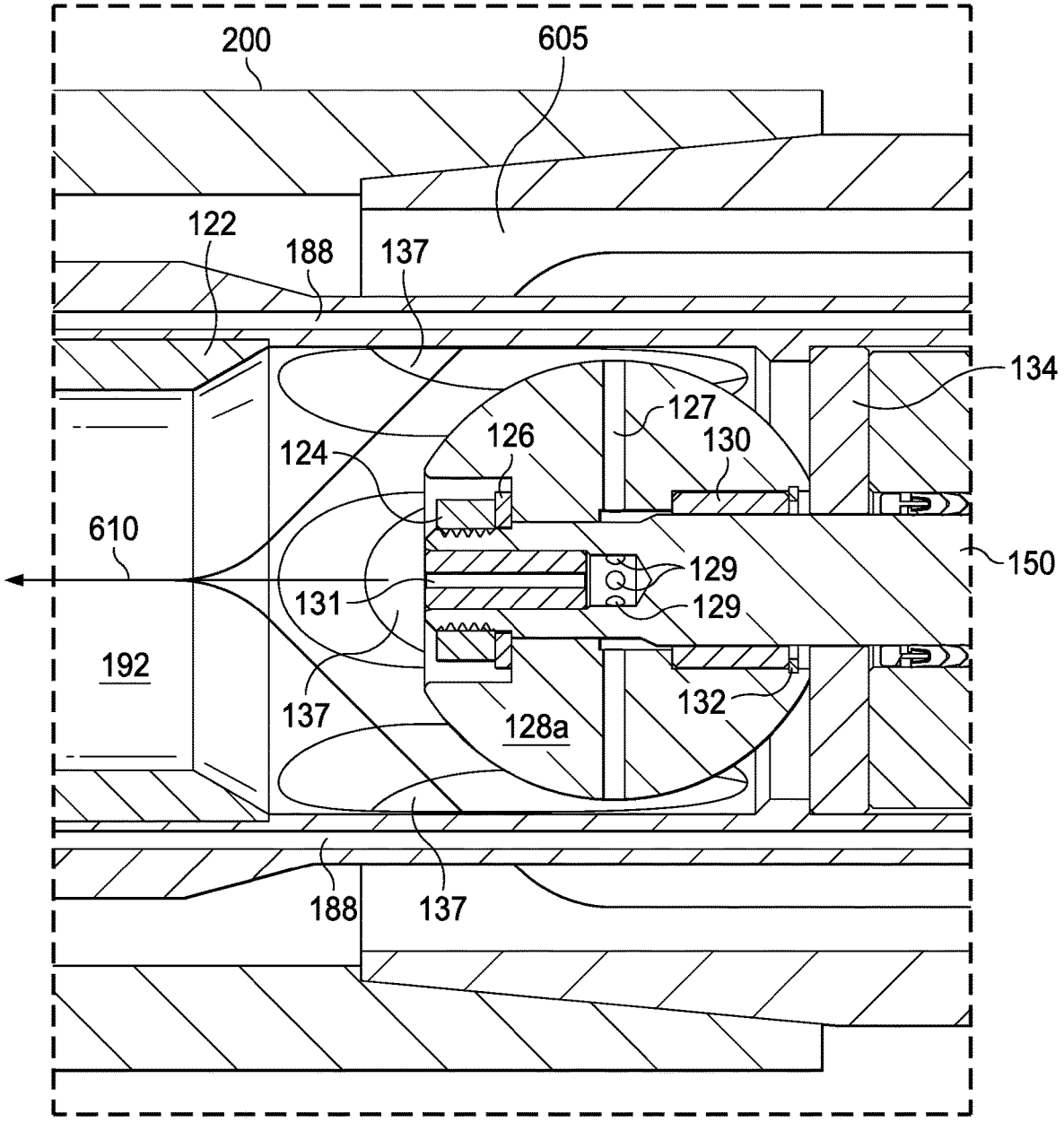
FIG. 5F shows a detail portion of FIG. 5C showing the closure device in an opened position in accordance with one or more embodiments of the present specification.

Continuing, FIG. 5C shows a cross-sectional view of a portion of the surface-controlled wireline-retrievable safety valve 100 disposed within the tubing-retrievable safety valve 200 with the closure device in an opened position in accordance with one or more embodiments of the present invention. After hydraulic equalization, the application of hydraulic actuation fluid (not shown) into the differential area 194 causes upper power piston 150 and lower power piston 158 to compress the power spring (not shown) causing closure device 128, e.g., ball 128*a*, to move off hard seat 122 and exposing the plurality of flow ports 137. In the opened state, safety valve 100 permits the flow of production fluids (not shown) from the annulus 605 between the production tubing 300 and safety valve 100 to flow into safety valve 100 via the plurality of flow ports 137 and into the central lumen 192 of safety valve 100.

Continuing, FIG. 5D shows a detail cross-sectional view of ball 128*a* and hard seat 122 of the surface-controlled wireline-retrievable safety valve 100 disposed within the tubing-retrievable safety valve 200 with the closure device in an opened position in accordance with one or more embodiments of the present invention. In this view, with the closure device 128, e.g., ball 128*a*, moved off hard seat 122, the flow path of production fluids 610 from the annulus 605 between production tubing 300 and safety valve 100 enters safety valve 100 via the plurality of flow ports 137 and return to the surface via the central lumen 192 of safety valve 100.

Figure 6D:
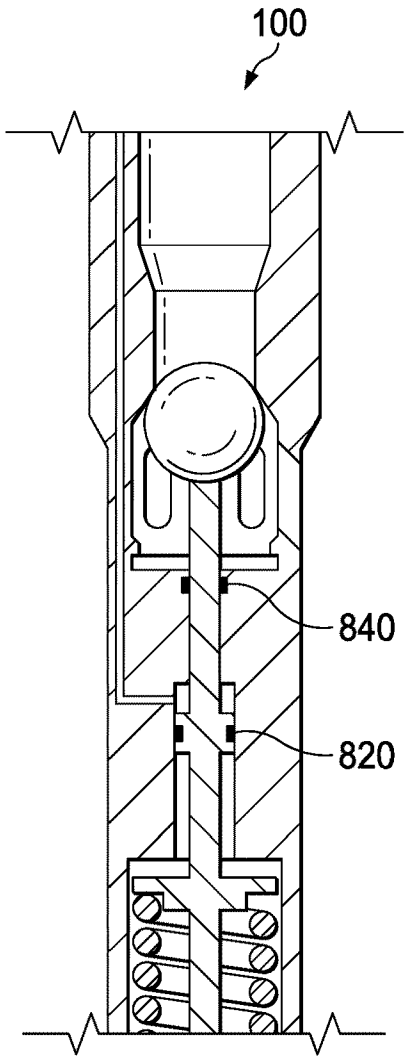
FIG. 6D shows a cross-sectional view of a rod seal/bore seal configuration of a surface-controlled wireline-retrievable safety valve in accordance with one or more embodiments of the present invention.
Figure 6C:
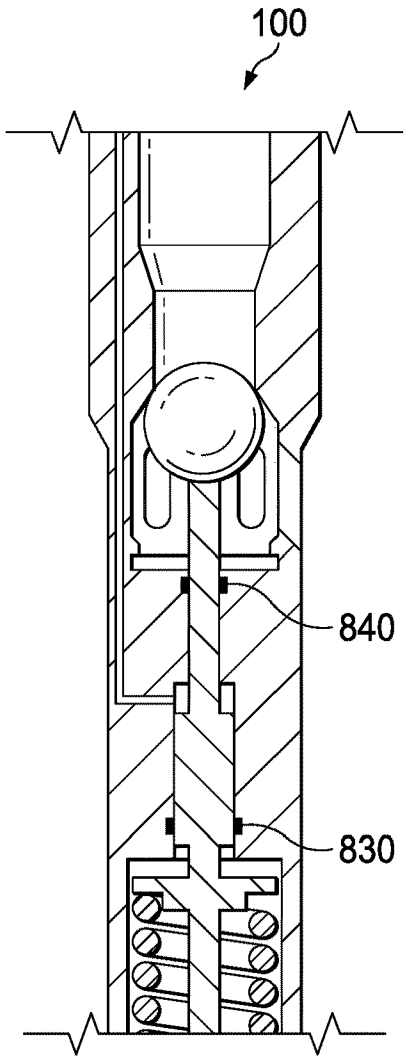
FIG. 6C shows a cross-sectional view of a rod seal/rod seal configuration of a surface-controlled wireline-retrievable safety valve in accordance with one or more embodiments of the present invention.
Figure 6B:
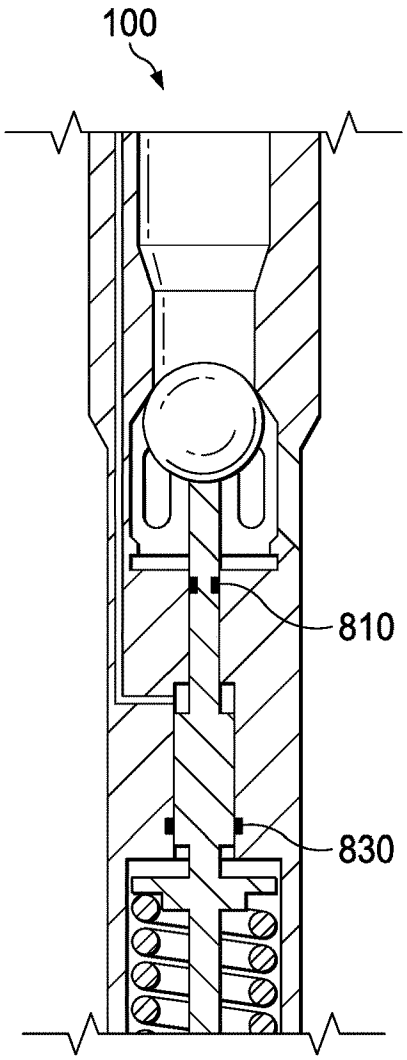
FIG. 6B shows a cross-sectional view of a bore seal/rod seal configuration of a surface-controlled wireline-retrievable safety valve in accordance with one or more embodiments of the present invention.
Figure 6A:
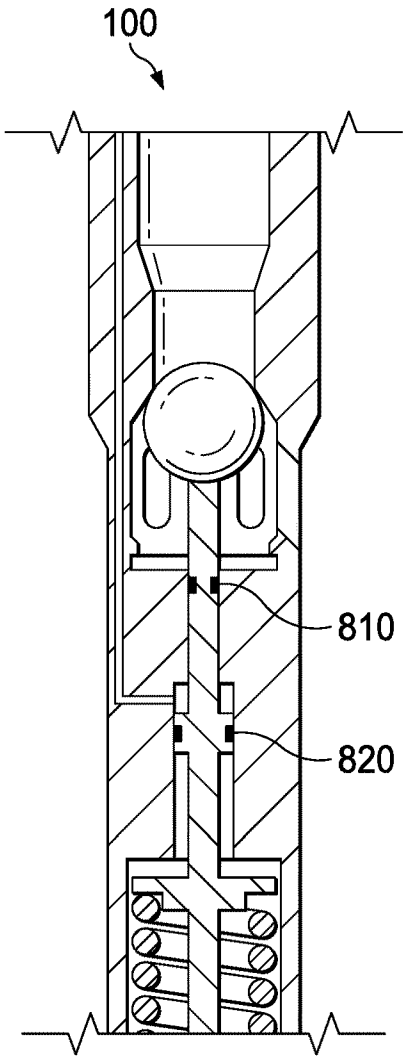
FIG. 6A shows a cross-sectional view of a bore seal/bore seal power seal configuration of a surface-controlled wireline-retrievable safety valve in accordance with one or more embodiments of the present invention.

FIG. 6A shows a cross-sectional view of a bore seal/bore seal power seal configuration of a surface-controlled wireline-retrievable safety valve 100 in accordance with one or more embodiments of the present invention. Continuing, FIG. 6B shows a cross-sectional view of a bore seal/rod seal configuration of a surface-controlled wireline-retrievable safety valve 100 in accordance with one or more embodiments of the present invention. Continuing, FIG. 6C shows a cross-sectional view of a rod seal/rod seal configuration of a surface-controlled wireline-retrievable safety valve 100 in accordance with one or more embodiments of the present invention. Continuing, FIG. 6D shows a cross-sectional view of a rod seal/bore seal configuration of a surface-controlled wireline-retrievable safety valve 100 in accordance with one or more embodiments of the present invention.

Figure 7:
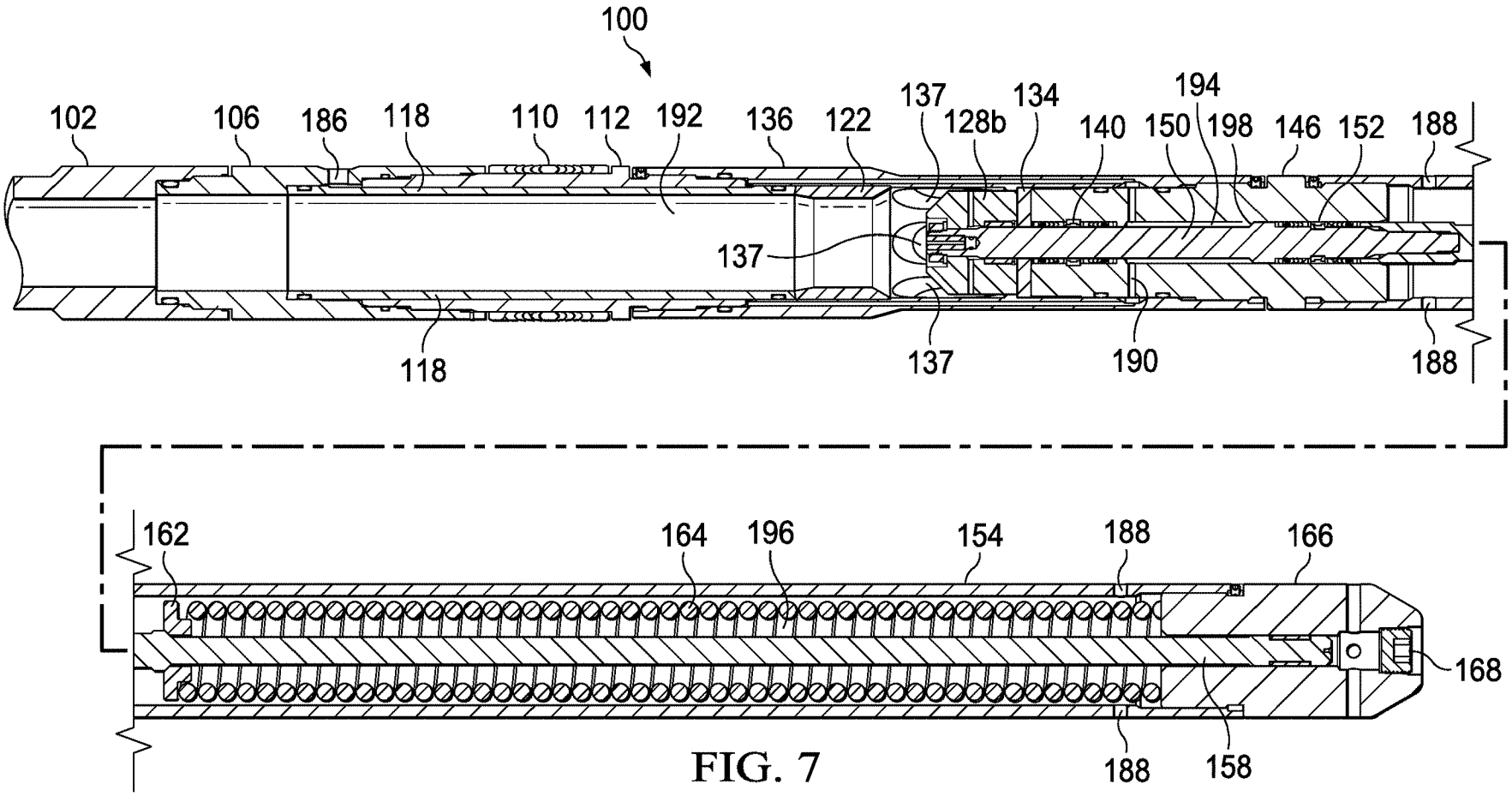
FIG. 7 shows a cross-sectional view of a surface-controlled wireline-retrievable safety valve in accordance with one or more embodiments of the present invention.

FIG. 7 shows a cross-sectional view of a surface-controlled wireline-retrievable safety valve 100 in accordance with one or more embodiments of the present invention. Safety valve 100 may use a different closure device 128, such as, for example, poppet 128*b*, instead of a ball (e.g., 128*a* of FIG. 3). One of ordinary skill in the art will recognize that poppets are well known in the industry and the shape, size, and configuration of poppet 128*b* may vary based on an application or design in accordance with one or more embodiments of the present invention. In addition, one of ordinary skill in the art will recognize that hard seat 122 may have a shape configured to receive poppet 128*b* in a similar manner to the hard seat and ball (e.g., 122 and 128*a* of FIG. 3) described with respect to one or more embodiments of the present invention.

Figure 8:
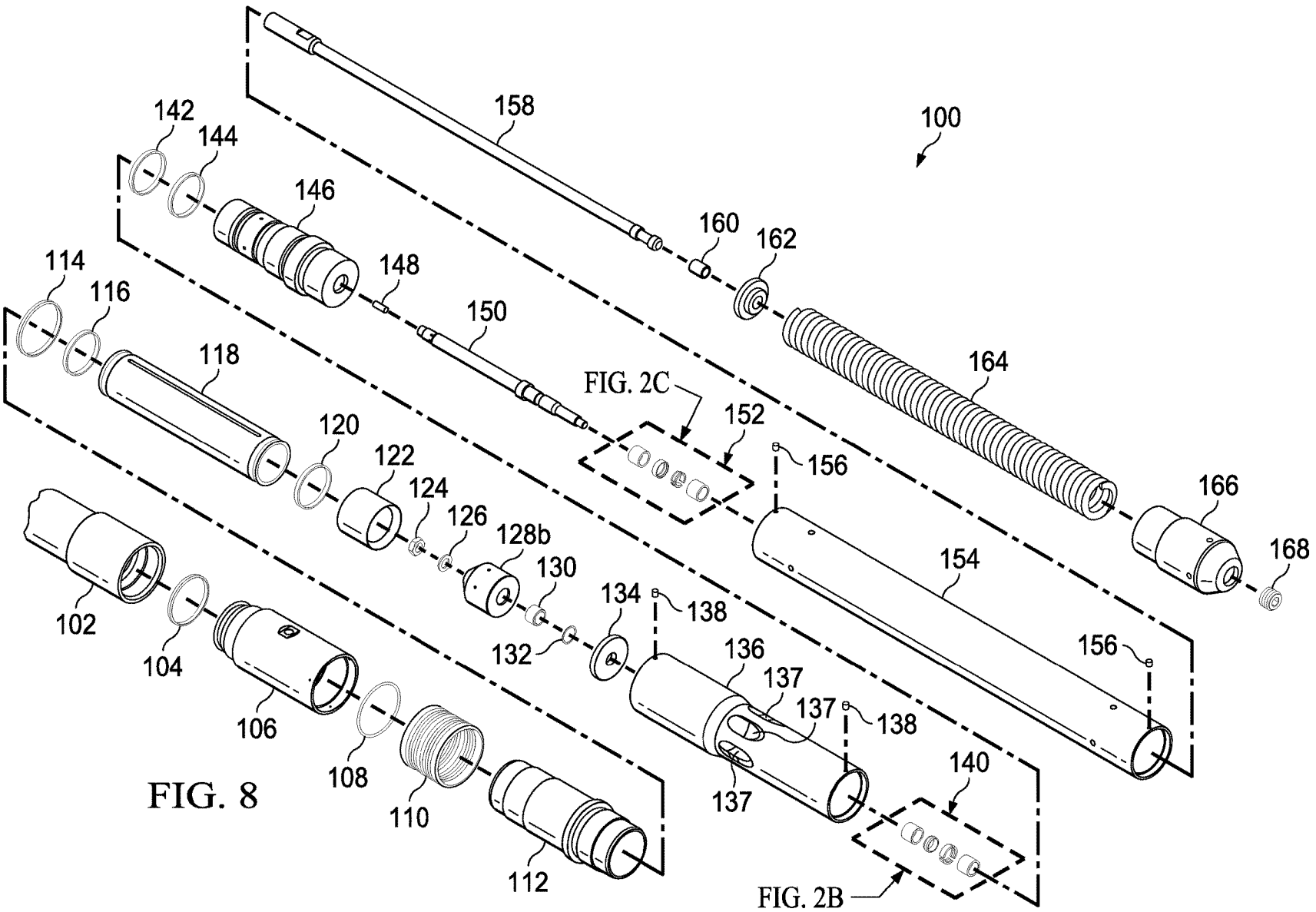
FIG. 8 shows an exploded perspective view of a surface-controlled wireline-retrievable safety valve in accordance with one or more embodiments of the present invention.

FIG. 8 shows an exploded perspective view of a surface-controlled wireline-retrievable safety valve 100 in accordance with one or more embodiments of the present invention.

Advantages of one or more embodiments of the present invention may include one or more of the following:

In one or more embodiments of the present invention, the energy used to close the closure device of a surface-controlled wireline-retrievable safety valve is stored below the closure device.

In one or more embodiments of the present invention, a surface-controlled wireline-retrievable safety valve provides more robust equalization than a conventional safety valve using a flapper, equalizing dart, or equalizing dart spring design. Advantageously, the hydraulic pressure across the closure device is automatically equalized, reducing the amount of hydraulic actuation pressure required to compress the power spring and open the closure device to expose the plurality of flow ports to production flow through the safety valve.

In one or more embodiments of the present invention, a surface-controlled wireline-retrievable safety valve may be run deeper for the same hydraulic actuation pressure than a conventional safety valve because the energy used to close the closure device of the safety valve is disposed below the closure device and the hydraulic pressure across the closure device is automatically equalized.

In one or more embodiments of the present invention, a surface-controlled wireline-retrievable safety valve provides an increased area for production flow through the safety valve than conventional safety valves including flapper-based safety valves and flow tube safety valves.

In one or more embodiments of the present invention, a surface-controlled wireline-retrievable safety valve reduces manufacturing complexity compared to that of conventional safety valves.

In one or more embodiments of the present invention, a surface-controlled wireline-retrievable safety valve provides extended service life compared to that of conventional safety valves because of its robust design that increases longevity.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A surface-controlled wireline-retrievable safety valve comprising:

a seat housing comprising a plurality of flow ports and configured to house a hard-seat;

a closure device comprising a plurality of equalization ports, wherein the closure device is disposed within the seat housing and is configured to controllably move off the hard seat and expose the plurality of flow ports to a central lumen of the safety valve under hydraulic actuation;

a power piston comprising a shoulder portion, wherein the power piston is attached to the closure device and the shoulder portion is disposed within a hydraulic chamber housing forming a differential area;

a hydraulic actuation port configured to receive hydraulic actuation fluid from a surface pump; and a hydraulic passage configured to convey the hydraulic actuation fluid from the hydraulic actuation port to the differential area via a hydraulic access port, wherein, under hydraulic actuation, prior to the closure device moving off the hard seat, production fluids entering the plurality of flow ports cause a metal-to-metal seal of the closure device to open allowing at least one of the plurality of equalization ports of the closure device to equalize hydraulic pressure across the closure device while the closure device is still on the hard seat, and wherein, under hydraulic actuation, hydraulic fluid in the differential area causes the power piston to compress a power spring and move the closure device off the hard seat exposing the plurality of flow ports to the central lumen of the safety valve.

2. The surface-controlled wireline-retrievable safety valve of claim 1, wherein the surface-controlled wireline-retrievable safety valve is configured to be at least partially disposed within a tubing-retrievable safety valve and at least partially disposed within production tubing.

3. The surface-controlled wireline-retrievable safety valve of claim 1, wherein, under hydraulic actuation, equalization of hydraulic pressure across the closure device allows the hydraulic actuation fluid to cause the power piston to compress the power spring.

4. The surface-controlled wireline-retrievable safety valve of claim 1, wherein, under hydraulic actuation, production fluids in an annulus between the surface-controlled wireline-retrievable safety valve and production tubing enter the surface-controlled wireline-retrievable safety valve via the plurality of flow ports and are conveyed to the surface via the central lumen of the surface-controlled wireline-retrievable safety valve.

5. The surface-controlled wireline-retrievable safety valve of claim 1, wherein, when hydraulic actuation is removed, stored energy in the power spring causes the closure device to move on the hard seat and close the plurality of flow ports.

6. The surface-controlled wireline-retrievable safety valve of claim 1, further comprising:

an upper power seal stack disposed within the hydraulic chamber housing about the power piston above the hydraulic access port and a lower power seal stack disposed within the hydraulic chamber housing about the power piston below the hydraulic access port.

7. The surface-controlled wireline-retrievable safety valve of claim 6, wherein the upper power seal comprises a bore seal and the lower power seal comprises a bore seal.

8. The surface-controlled wireline-retrievable safety valve of claim 6, wherein the upper power seal comprises a bore seal and the lower power seal comprises a rod seal.

9. The surface-controlled wireline-retrievable safety valve of claim 6, wherein the upper power seal comprises a rod seal and the lower power seal comprises a rod seal.

10. The surface-controlled wireline-retrievable safety valve of claim 6, wherein the upper power seal comprises a rod seal and the lower power seal comprises a bore seal.

11. The surface-controlled wireline-retrievable safety valve of claim 6, wherein the upper power seal comprises an upper seal stack, a seal glide ring, a seal load ring, and a lower seal stack.

12. The surface-controlled wireline-retrievable safety valve of claim 6, wherein the lower power seal comprises an upper seal stack, a seal glide ring, a seal load ring, and a lower seal stack.

13. The surface-controlled wireline-retrievable safety valve of claim 1, wherein the closure device comprises:

a ball comprising a central lumen configured to receive a top distal end of the power piston and the plurality of equalization ports;

an insert equalization port that fluidly connects to the plurality of equalization ports under fluid pressure;

a retaining nut and a retaining washer disposed about the top distal end of the power piston above the plurality of equalization ports configured to secure the ball to the top distal end of the power piston; and a bushing and a bushing retainer disposed about a portion of the power piston below the plurality of equalization ports within the ball.

14. The surface-controlled wireline-retrievable safety valve of claim 13, wherein the hard seat comprises a conical section configured to receive the ball.

15. The surface-controlled wireline-retrievable safety valve of claim 14, wherein each of the plurality of flow ports comprise a conical section cutout in the seat housing.

16. The surface-controlled wireline-retrievable safety valve of claim 15, wherein when the closure device is on the hard seat, the plurality of flow ports are not exposed to the central lumen of the surface-controlled wireline-retrievable safety valve.

17. The surface-controlled wireline-retrievable safety valve of claim 15, wherein when the closure device is off the hard seat, the plurality of flow ports are exposed to the central lumen of the surface-controlled wireline-retrievable safety valve.

18. The surface-controlled wireline-retrievable safety valve of claim 1, further comprising:

a spacer configured to removably connect with an adapter sub of the surface-controlled wireline-retrievable safety valve, wherein the spacer is configured to dispose the surface-controlled wireline-retrievable safety valve within a tubing-retrievable safety valve such that a flapper of the tubing-retrievable safety valve remains in an open state.

19. The surface-controlled wireline-retrievable safety valve of claim 1, wherein the closure device comprises:

a poppet comprising a central lumen configured to receive a top distal end of the power piston and the plurality of equalization ports;

an insert equalization port that fluidly connects to the plurality of equalization ports under fluid pressure;

a retaining nut and a retaining washer disposed about the top distal end of the power piston above the plurality of equalization ports configured to secure the poppet to the top distal end of the power piston; and a bushing and a bushing retainer disposed about a portion of the power piston below the plurality of equalization ports within the poppet.

* * * * *